US009314063B2

(12) United States Patent
Bologna et al.

(10) Patent No.: US 9,314,063 B2
(45) Date of Patent: Apr. 19, 2016

(54) FOOTBALL HELMET WITH IMPACT ATTENUATION SYSTEM

(71) Applicant: Riddell, Inc., Rosemont, IL (US)

(72) Inventors: Vittorio Bologna, Elk Grove Village, IL (US); Nelson Kraemer, Mount Prospect, IL (US); Thad M. Ide, Chicago, IL (US)

(73) Assignee: Riddell, Inc., Rosemont, IL (US)

( * ) Notice: Subject to any disclaimer, the term of this patent is extended or adjusted under 35 U.S.C. 154(b) by 0 days.

(21) Appl. No.: 14/179,484

(22) Filed: Feb. 12, 2014

(65) Prior Publication Data

US 2014/0223644 A1 Aug. 14, 2014

Related U.S. Application Data

(60) Provisional application No. 61/763,802, filed on Feb. 12, 2013.

(51) Int. Cl.

| | |
|---|---|
| ***A42B 3/12*** | (2006.01) |
| ***A42B 3/20*** | (2006.01) |
| ***A42B 3/06*** | (2006.01) |

(52) U.S. Cl.

CPC . *A42B 3/20* (2013.01); *A42B 3/068* (2013.01); *A42B 3/128* (2013.01)

(58) Field of Classification Search

CPC ..... A42B 3/00; A42B 3/324; A42B 3/06
USPC ..... 2/410
See application file for complete search history.

(56) References Cited

U.S. PATENT DOCUMENTS

| | | | | |
|---|---|---|---|---|
| 3,197,784 | A * | 8/1965 | Carlisle | 2/420 |
| 6,154,889 | A * | 12/2000 | Moore et al. | 2/418 |
| 2009/0031479 | A1 | 2/2009 | Rush, III | |
| 2011/0271428 | A1 | 11/2011 | Withnall et al. | |

* cited by examiner

*Primary Examiner* — Anna Kinsaul
(74) *Attorney, Agent, or Firm* — McDermott Will & Emery LLP

(57) ABSTRACT

A protective football helmet is provided having a one-piece molded shell with an impact attenuation system. This system includes an impact attenuation member formed in an extent of the front shell portion by removing material from the front portion. The impact attenuation member is purposely engineered to change how the front portion responds to an impact force applied substantially normal to the front portion as compared to how other portions of the shell respond to that impact force. In one version, the impact attenuation member is a cantilevered segment formed in the front portion of the shell.

37 Claims, 18 Drawing Sheets

FOOTBALL HELMET WITH IMPACT ATTENUATION SYSTEM

CROSS-REFERENCE TO RELATED APPLICATIONS

The present application claims the benefit of priority under 35 U.S.C. §119 from U.S. Provisional Patent Application Ser. No. 61/763,802 entitled "PROTECTIVE SPORTS HELMET WITH ENGINEERED ENERGY DISPERSION SYSTEM," filed on Feb. 12, 2013, the disclosure of which is hereby incorporated by reference in its entirety for all purposes.

TECHNICAL FIELD

The invention relates to a protective football helmet including a one-piece, molded shell and an impact attenuation system purposely engineered to adjust a specific portion of the helmet's behavior when an impact or series of impacts are received by the helmet. The impact attenuation system includes an impact attenuation member formed in the shell and an internal pad aligned with the impact attenuation member on the inner surface of the shell.

BACKGROUND OF THE INVENTION

Helmets for contact sports, such as those used in football, hockey and lacrosse, typically include a rigid outer shell, an internal pad assembly coupled to an interior surface of the shell, a faceguard or face mask, and a chin protector or strap that removably secures the helmet on the wearer's head. Conventional sports helmets may include ribs, ridges, and/or corrugations formed in the helmet shell, along with numerous openings in the shell. These openings can include openings for the attachment of other helmet features, such as the faceguard, the chin strap, and the internal padding assembly. These openings can also include ear hole apertures to improve hearing, and ventilation apertures to improve ventilation while the helmet is on the wearer's head.

In conventional helmets, the size, shape, and location of these openings are designed to minimize any structural weakness in the shell that may result from removing material from the shell to form these openings. The various ribs, ridges and corrugations found in conventional sports helmets often function to increase shell stiffness, especially in the regions of the shell that include these features. The performance of the helmet is complicated by the inclusion of the combination of multiple shell openings and ribs, ridges and/or corrugations.

Features and advantages of the invention will be apparent to those skilled in the art upon review of the following detailed description and accompanying drawings.

SUMMARY OF THE INVENTION

The disclosed subject matter relates to a protective football helmet having a one-piece molded shell with an impact attenuation system. The one-piece shell includes a crown portion defining an upper region of the shell. The one-piece shell also includes a front portion extending generally forwardly and downwardly from the crown portion. The one-piece shell further includes left and right side portions extending generally downwardly and laterally from the crown portion. The one-piece shell also includes an impact attenuation member formed in an extent of the front portion by removing material from the front portion. The impact attenuation member is purposely engineered to change how the front portion responds to an impact force applied substantially normal to the front portion as compared to how other portions of the shell respond to that impact force. In one version of the helmet, the impact attenuation member is a cantilevered segment formed in the front portion of the shell.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
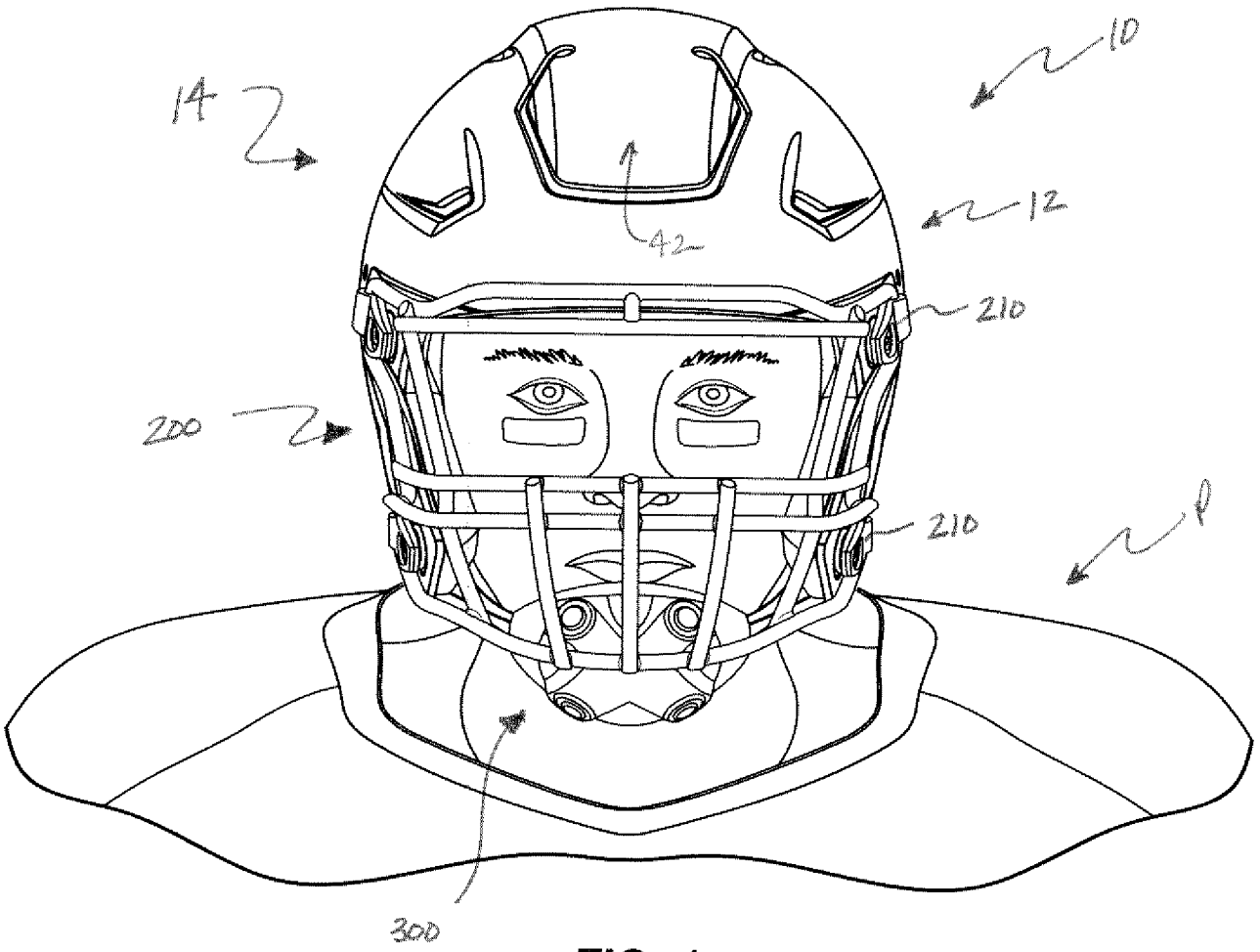
FIG. 1 is a front view of a football helmet of the invention, the helmet being worn by a player.
Figure 2:
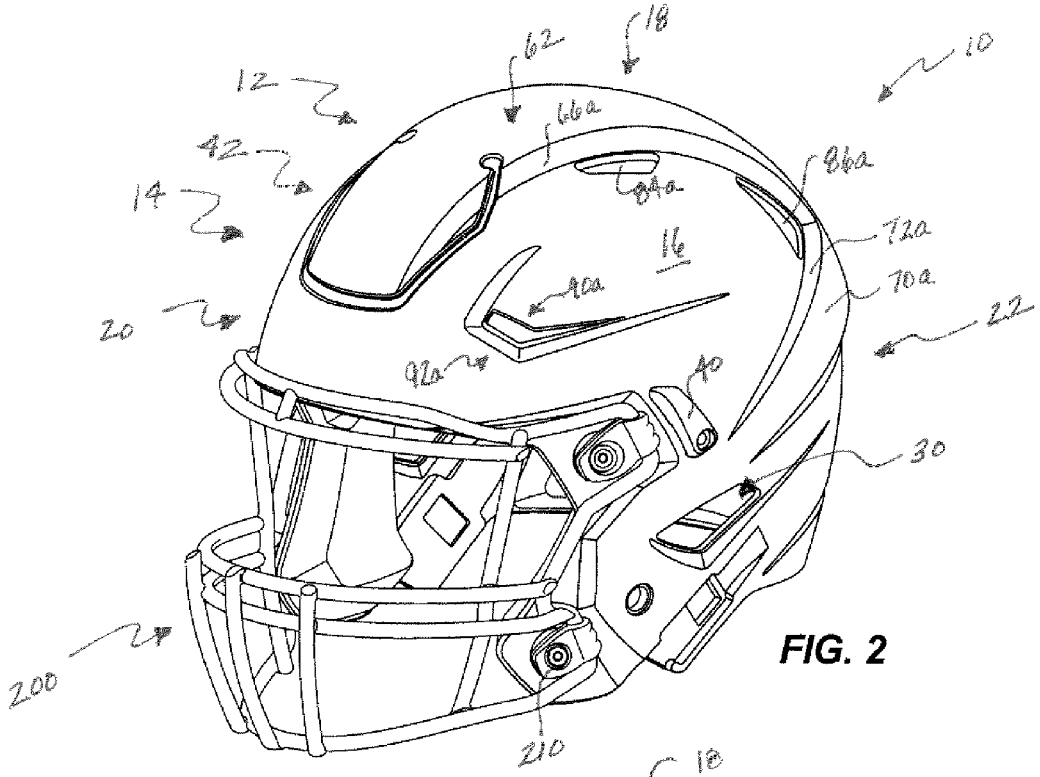
FIG. 2 is a front perspective view of the football helmet of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-13 illustrate a protective football helmet 10 with a durable, one-piece molded shell 12 and an impact attenuation system 14. As explained in greater detail below, the impact attenuation system 14 is specifically designed and engineered to adjust how the helmet 10 responds to impact forces occurring while playing football and manages the energy resulting from those impacts. It is understood by those of skill in the art of designing protective football helmets that different regions of the football helmet experience impacts of different types, magnitudes and durations during the course of playing football. It is also understood that the types, magnitudes and durations of impact forces are different in contact sports, such as football, hockey and lacrosse because these sports differ in many significant ways, e.g., the underlying nature of the play, the number and type of players, the equipment worn by the players, and the playing surface. It is further understood that while playing football, a player may experience multiple impacts to the same or different regions of the helmet during a single play or a series of plays. The impact attenuation system 14 is purposely designed to adjust how select portions of the helmet 10 respond to impact forces by adjusting the dynamic performance of the portion having the system 14 compared to adjacent portions lacking the system 14. In one embodiment, a first portion of the helmet 10 that includes the system 14 has increased flexibility and as a result, behaves differently than an adjacent second portion of the helmet 10 lacking the system 14, when an impact force(s) is applied normal to the first and/or second portions of the helmet. Conventional football helmets lack these structural and functional aspects. As explained in greater detail below, the impact attenuation system 14 comprises at least one impact attenuation member 42 and a corresponding internal front pad member 410.

FIG. 1 shows the helmet 10 being worn by a wearer or player P. In addition to the impact attenuation system 14, the helmet 10 includes the shell 12 and a facemask or face guard 200 attached at upper and lower frontal regions of the shell 12 by removable connectors 210. The face guard 200 comprises an arrangement of elongated and intersecting members and is designed to span a frontal opening in shell to protect the facial area and chin of the player P. The one-piece, molded (either injection or thermoformed) shell 12 is formed from a hard plastic or polymer material, such as polycarbonate, acrylonitrile butadiene styrene (ABS), or nylon. The helmet 10 also includes a chin strap assembly 300 and an internal pad assembly 400 (see FIGS. 12 and 13) that is detailed below.

As shown in FIGS. 1-7, the shell 12 includes an outer surface 16 featuring complex contours and facets. The shell 12 also includes a crown portion 18 defining a top region of the helmet 10, a front portion 20 extending generally forwardly and downwardly from the crown portion 18, left and right side portions 24 extending generally downwardly and laterally from the crown portion 18, and a rear portion 22 extending generally rearwardly and downwardly from the crown portion 18. The left and right side portions 24 each include an ear flap 26 positioned generally to overlie and protect the ear region of the player P when the helmet 10 is worn. Each ear flap 26 may be provided with an ear hole 30 to improve hearing for the wearer. The shell 12 is symmetric along a vertical plane dividing the shell 12 into left and right halves. When the helmet 10 is worn by the player P, this vertical plane is aligned with the midsagittal plane that divides the player P (including his head) into symmetric right and left halves, wherein the midsagittal plane is shown in the NOCSAE standard ND002 for newly manufactured football helmets. Therefore, features shown in Figures as appearing in one half of the shell 12 are also present in the other half of the shell 12.

Figure 3:
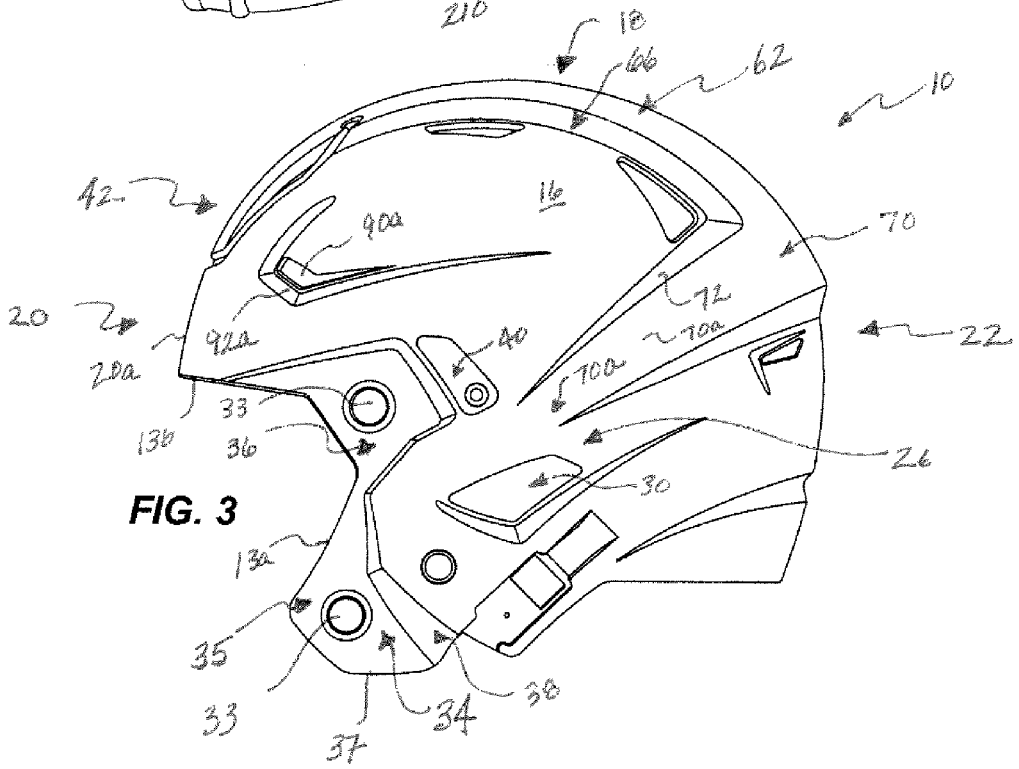
FIG. 3 is a left side view of the football helmet of FIG. 1.
Figure 5:
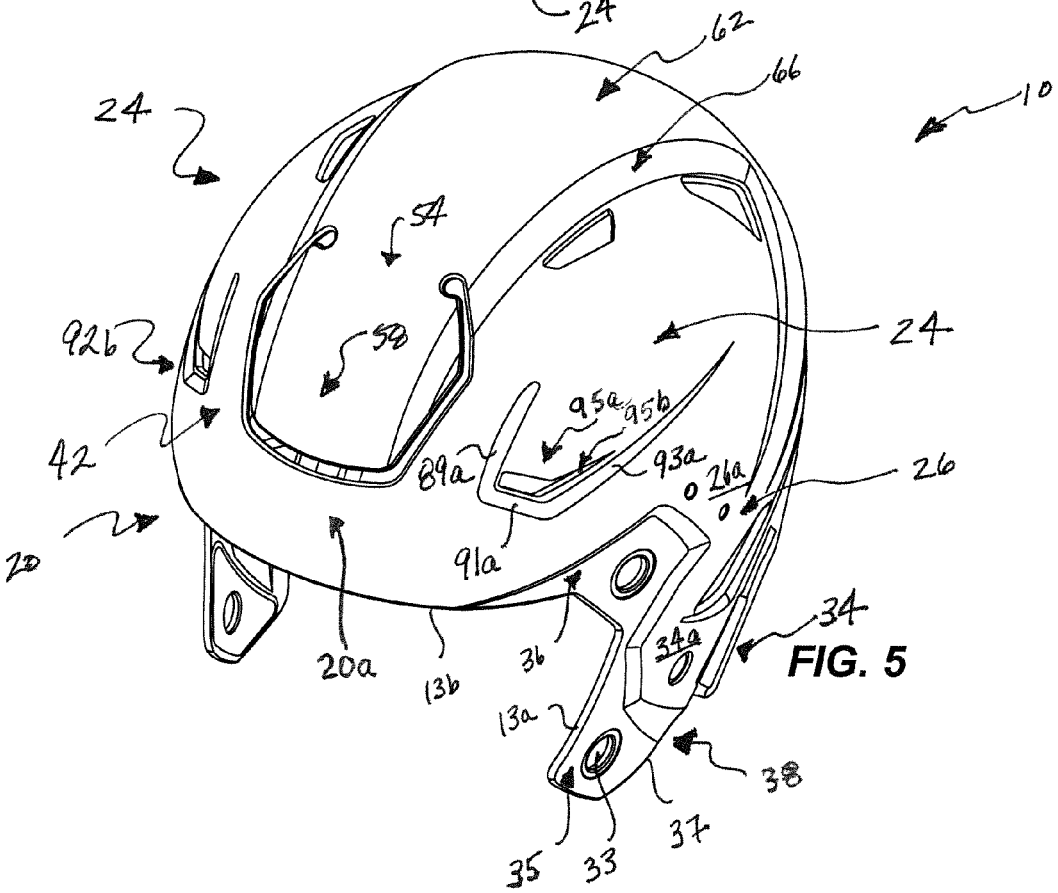
FIG. 5 is a top perspective view of the football helmet of FIG. 1, the internal padding assembly omitted from the helmet.

The shell 12 also includes a pair of jaw flaps 34, with each jaw flap 34 extending generally forwardly from a respective one of the ear flaps 26 for protection of the mandible area of the player P. In the illustrated configuration, the jaw flaps 34 also include a lower face guard attachment region 35. An upper face guard attachment region 36 is provided near a peripheral frontal edge 13*a* of the shell 12 and above the ear hole 30. Each attachment region 35, 36 includes an aperture 33 that receives a fastener extending through the face guard connector 210 to secure the face guard 200 to the shell 12. Preferably, the lower face guard attachment region 35 is recessed inward compared to the adjacent outer surface 34*a* of the jaw flap 34, and the upper face guard attachment region 36 is recessed inward compared to the adjacent outer surface 26*a* of the ear flap 26. As shown in FIGS. 3 and 5, there is an angled transition wall 38 extending inward from the ear flap outer surface 26*a* and the jaw flap outer surface 34*a* to the recessed attachment regions 35, 36. The transition wall 38 extends from the central frontal edge 13*b* in the front portion 20 rearward and then downward to a lower edge 37 of the jaw flap 34. A chin strap securement member 40 is positioned rearward of the upper face guard attachment region 36 and is configured to receive a strap member of the chin strap assembly 300.

Figure 4:
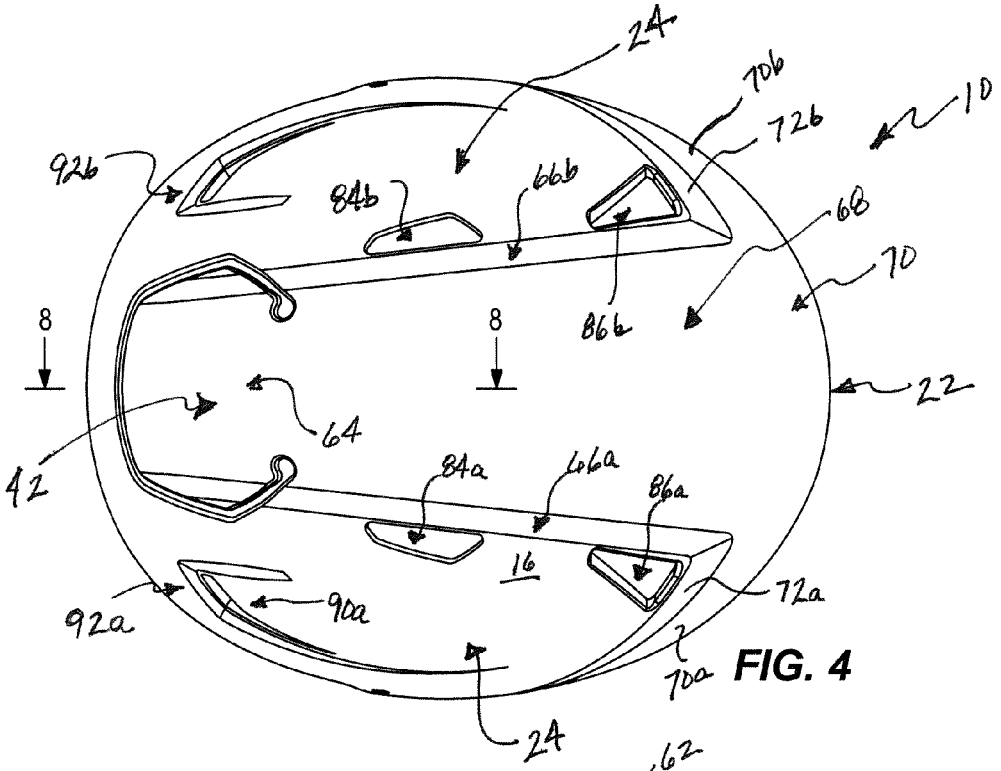
FIG. 4 is a top view of the football of FIG. 1.
Figure 7:
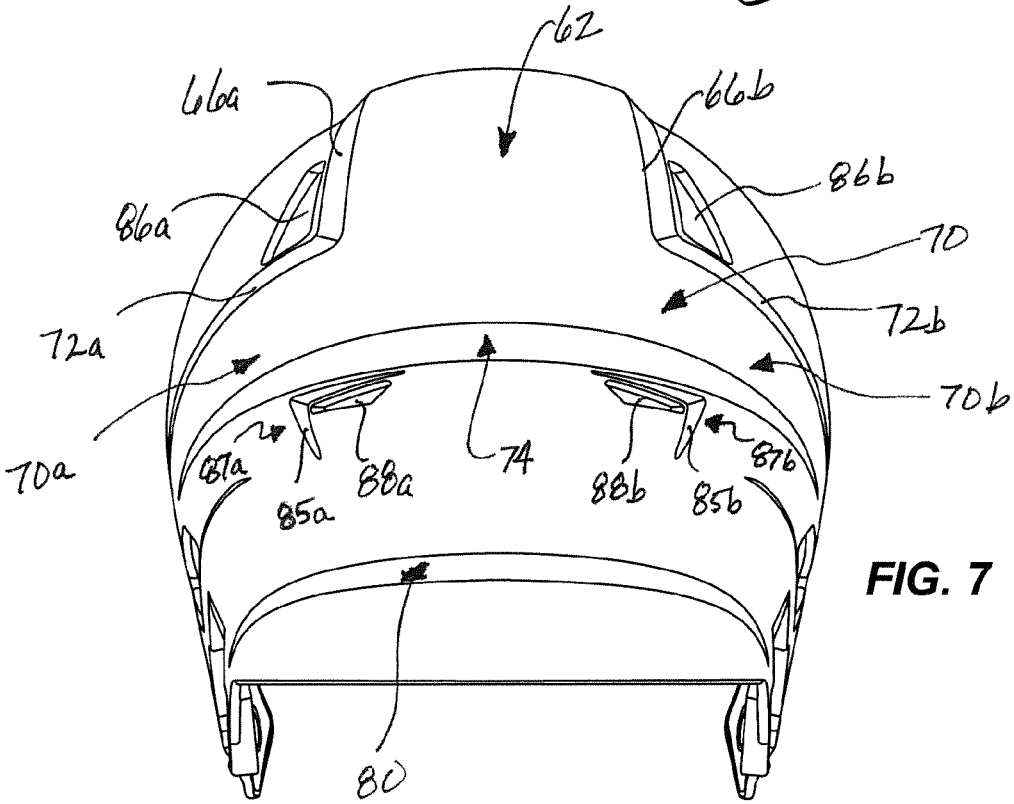
FIG. 7 is a rear view of the football helmet of FIG. 1, the internal padding assembly omitted from the helmet.

The helmet 10 also includes a raised central band 62 that extends from the front shell portion 20 across the crown portion 18 to the rear shell portion 22. The band 62 is defined by a pair of substantially symmetric raised sidewalls or ridges 66 that extend upwardly at angle from the outer shell surface 16. When viewed from the side, the sidewalls 66 define a curvilinear path as they extend across the crown portion 18 to the rear shell portion 22. As explained in detail below, a front portion 64 of the band 62 is coincident with the impact attenuation member 42 and is positioned a distance above the central frontal edge 13*b*. Referring to FIGS. 4 and 5, the band 62 has a width that increases as the band 62 extends from the front shell portion 20 across the crown portion 18 to the rear shell portion 22. As shown in FIGS. 3, 4 and 7, a rear portion 68 of the band 62 is coincident with and merges with a rear raised band 70 that extends transversely between the left and right side portions 24 of the shell 12. Referring to FIG. 4, the left sidewall 66*a* intersects with an upper left sidewall 72*a* of the transverse band 70, and the right sidewall 66*b* intersects with an upper right sidewall 72*b* of the transverse band 70, wherein each of these intersections define a substantially right angle. A lower transverse sidewall 74 extends from the outer shell surface 16 along the length of the transverse rear band 70. Similar to the sidewalls 66, the rear band sidewalls 72, 74 are sloped meaning they extend outwardly and upwardly at angle from the outer shell surface 16. Referring to FIG. 7, a lower channel 80 extends transversely below the raised rear band 70 and above a lower rear shell edge 81.

As shown in the Figures, the helmet 10 further includes numerous vent openings that are configured to facilitate circulation within the helmet 10 when it is worn by the player P. A first pair of vent openings 84 are formed in the crown portion 18, wherein the left vent opening 84*a* is substantially adjacent the left sidewall 66*a* and the right vent opening 84*b* is substantially adjacent the right sidewall 66*b*. The left and right vent openings 84*a,b* have a longitudinal centerline that is generally aligned with an adjacent extent of the respective sidewall 66*a,b*. A second pair of vent openings 86 are formed in the rear shell portion 22, wherein the left vent opening 86*a* is substantially adjacent the left sidewall 66*a* and left band sidewall 72*a*, and the right vent opening 86*b* is substantially adjacent the right sidewall 66*b* and right band sidewall 72*b*. The left and right vent openings 86*a,b* have a longitudinal centerline that is generally aligned with the respective sidewall 66*a, b*. In this manner, the left first and second vent openings 84*a*, 86*a* are substantially aligned along the left sidewall 66*a*, and the right first and second vent openings 84*a*, 86*a* are substantially aligned along the right sidewall 66*b*.

Referring to FIG. 7, a third pair of vent openings 88 are formed in the rear shell portion 22 below the rear raised band 70, wherein the left vent opening 88*a* is positioned adjacent a left ridge 87*a* formed by an angled sidewall 85*a* and the right vent opening 88*b* is positioned adjacent a right ridge 87*b* formed by an angled sidewall 85*b*. The third vent openings 88*a,b* have a longitudinal centerline that is oriented substantially perpendicular to the raised central band 62 and that would intersect, if extended, the ear opening 30. A fourth pair of vent openings 90 are formed in the front shell portion 20, wherein the left vent opening 90*a* is positioned adjacent a left frontal ridge 92*a* and the right vent opening 92*a* is positioned adjacent a right frontal ridge 92*b*. The frontal ridges 92*a,b* are located between the front shell portion 20 and the side portion 24 and thus generally overlie the temple region of the player P when the helmet 10 is worn. Referring to FIG. 5, the frontal ridges 92*a,b* are also formed from an angled sidewall and include an upper inclined segment 89*a,b*, a declining intermediate segment 91*a,b* and a lower segment 93*a,b* that extends rearward at a slight angle towards the side shell portion 24. The fourth vent openings 90*a,b* have a major component 95*a,b* and a minor component 97*a,b* wherein the major component 95*a,b* is aligned with the upper segment 89*a,b* and the intermediate segment 91*a,b*, and the minor component 97*a,b* has a width that tapers as it extends along the lower segment 93*a,b*. The outer shell surface 16 adjacent and rearward of the vent openings 90*a,b* is recessed relative to the outer shell surface 16 adjacent and forward of the frontal ridges 92*a,b*. The first, second, third and fourth vent openings 84*a,b*, 86*a,b*, 88*a,b* and 90*a,b* are cooperatively positioned with voids in the internal padding assembly 400 to facilitate the flow of air through the helmet 10.

The helmet 10 shown in the Figures is an adult size large model, which correspond to a hat size of 7-7.5 and a head circumference of 22-23.5 inches. The dimensions discussed below apply to most adult sized models, most specifically the adult size large model. At its front portion 64, the central band 62 has a width of at least 2.0 inches, and preferably at least 2.25 inches, and most preferably at least 2.5 inches and less than 3.5 inches. Proximate the juncture of the raised central band 62 and the raised rear band 70, the raised central band 62 has a width of at least 4.0 inches, and preferably at least 4.25 inches, and most preferably at least 4.5 inches and less than 5.0 inches. At this same juncture, the raised band 70 has a height of at least 1.25 inch, and preferably at least 1.5 inch, and most preferably at least 1.5 inch and less than 2.0 inches. At the region where the terminal ends 70*a* of the rear raised band 70 merges flush with the outer shell surface 16, slightly rearward of the ear opening 30 (see FIG. 3), the terminal end 70*a* of the raised band 70 has a height of at least 0.75 inch, and preferably at least 1.0 inch and less than 1.75 inch. Accordingly, the height of the raised rear band 70 tapers as the each lateral band segment 70*b* extends from the raised central band 62 forward towards the respective ear flap 26. Because the raised central band 62 and the raised rear band 70 are formed as corrugations in the shell 12, the foregoing dimensions contribute to increasing the mechanical properties of the crown portion 18 and the rear shell portion 22, namely the structural modulus ($E_s$), of these portions 18, 22. The structural modulus provides a stiffness value of a respective portion of the helmet 10 based upon its geometry. A higher structural modulus value corresponds to increased stiffness of that portion of the helmet 10.

As explained above, the helmet's engineered impact attenuation system 14 includes the impact attenuation member 42 which adjusts how the portion of the helmet 10 including the member 42 responds to impact forces compared to adjacent portions of the helmet 10 lacking the member 42. The impact attenuation member 42 is formed by altering at least one portion of the shell 12 wherein that alteration changes the configuration of the shell 12 and its local response to impact forces. For example, in the illustrated configuration, the impact attenuation member 42 includes an internal cantilevered segment or flap 44 formed in the front shell portion 20. Compared to the adjacent portions of the shell 12 that lack the cantilevered segment 44, the front shell portion 20 has a lower structural modulus ($E_s$) which improves the attenuation of energy associated with impacts to at least the front shell portion 20. Thus, the configuration of the helmet 10 provides localized structural modulus values for different portions of the helmet 10. Although the illustrated embodiment of the helmet 10 includes only a frontal impact attenuation member 42, the helmet 10 could also include an impact attenuation member 42 in the crown portion 18, the rear shell portion 22 and/or the side shell portions 24.

Figure 6:
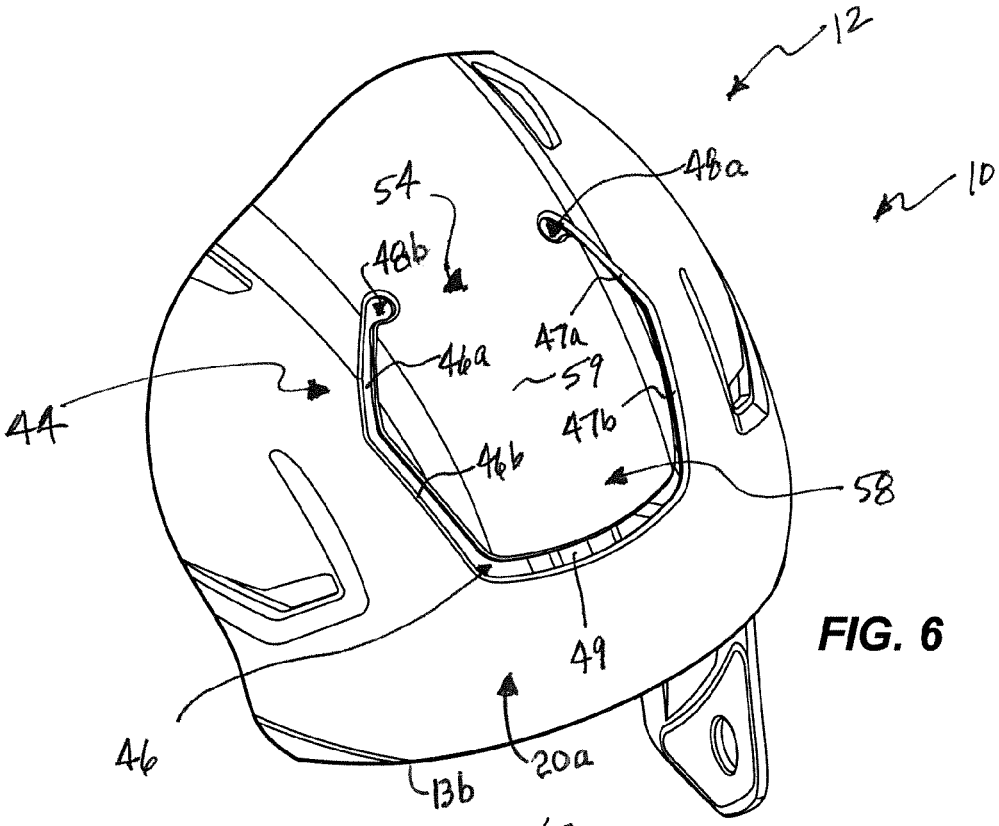
FIG. 6 is an enlarged perspective view of an impact attenuation system of the football helmet of FIG. 1, the internal padding assembly omitted from the helmet.

As shown in the Figures, most particularly FIGS. 4-6, the illustrated cantilevered segment 44 is formed by removing material from the shell 12 to define a multi-segment gap or opening 46, which partially defines a boundary of the cantilevered segment 44. Unlike conventional impact force management techniques that involve adding material to a helmet, the impact attenuation system 14 involves the strategic removal of material from the helmet 10 to integrally form the cantilevered segment 44 in the shell 12. The cantilevered segment 44 depends downward from an upper extent of the front shell portion 20 near the interface between the front portion 20 and the crown portion 18. Referring to FIGS. 5, 6 and 8-11, the cantilevered segment 44 includes a base 54 and a distal free end 58, and approximates the behavior of a living hinge when a substantially frontal impact is received by the front shell portion 20. The lowermost edge of the free end 58 is positioned approximately 1.5-2.5 inches, preferably 2.0 inches from the central frontal edge 13*b*, wherein the lower frontal region 20*a* of the front shell portion 20 is there between. As shown in the Figures, the lower frontal region 20*a* is an extent of the front portion 20 of the shell 12 that resides below the cantilevered segment 44 and above the lower frontal edge 13*b* of the shell 12.

As shown in FIG. 6, the opening 46 and the cantilevered segment 44 are generally U-shaped with an upward orientation meaning that they are oriented upwards towards the crown portion 18. The opening 46 has a complex geometry with a number of distinct segments. A first generally vertical right segment 46*a* extends downward and outward from a right end point 48*a* towards the right side of the front shell portion 20. A second generally vertical right segment 46*b* extends downward and inward from the first right segment 46*a* to a generally lateral segment 49. Similarly, a first generally vertical left segment 47*a* extends downward and outward from a left end point 48*b* towards the left side of the front shell portion 20. A second generally vertical left segment 47*b* extends downward and inward from the first left segment 47*a* to the lateral segment 49. The lateral segment 49 extends between the second right and left segments 46*b*, 47*b*. The lowermost extent of the lower, second right and left segments 46*b*, 47*b* is positioned approximately 1.5-2.5 inches, preferably 2.0 inches from the central frontal edge 13*b*. In illustrated embodiment, the lateral segment 49 forms an obtuse angle with the respective second right and left segments 46*b*, 47*b*, and the first right and left segments 46*a*, 47*a* form an obtuse angle with the respective second right and left segments 46*b*, 47*b*. Also, the left and right end points 48*a,b* have a substantially circular configuration with a width that exceeds the width of the opening 46. Although the illustrated first and second segments 46*a,b*, 47*a,b* and the lateral segment 49 are substantially linear, these segments can be configured as curvilinear or a combination of curvilinear and straight segments. Furthermore, the opening 46 may be formed by more or less than the five segments 46*a,b*, 47*a,b* and 49, as shown, for example, in the alternative embodiments discussed below.

Figure 8A:
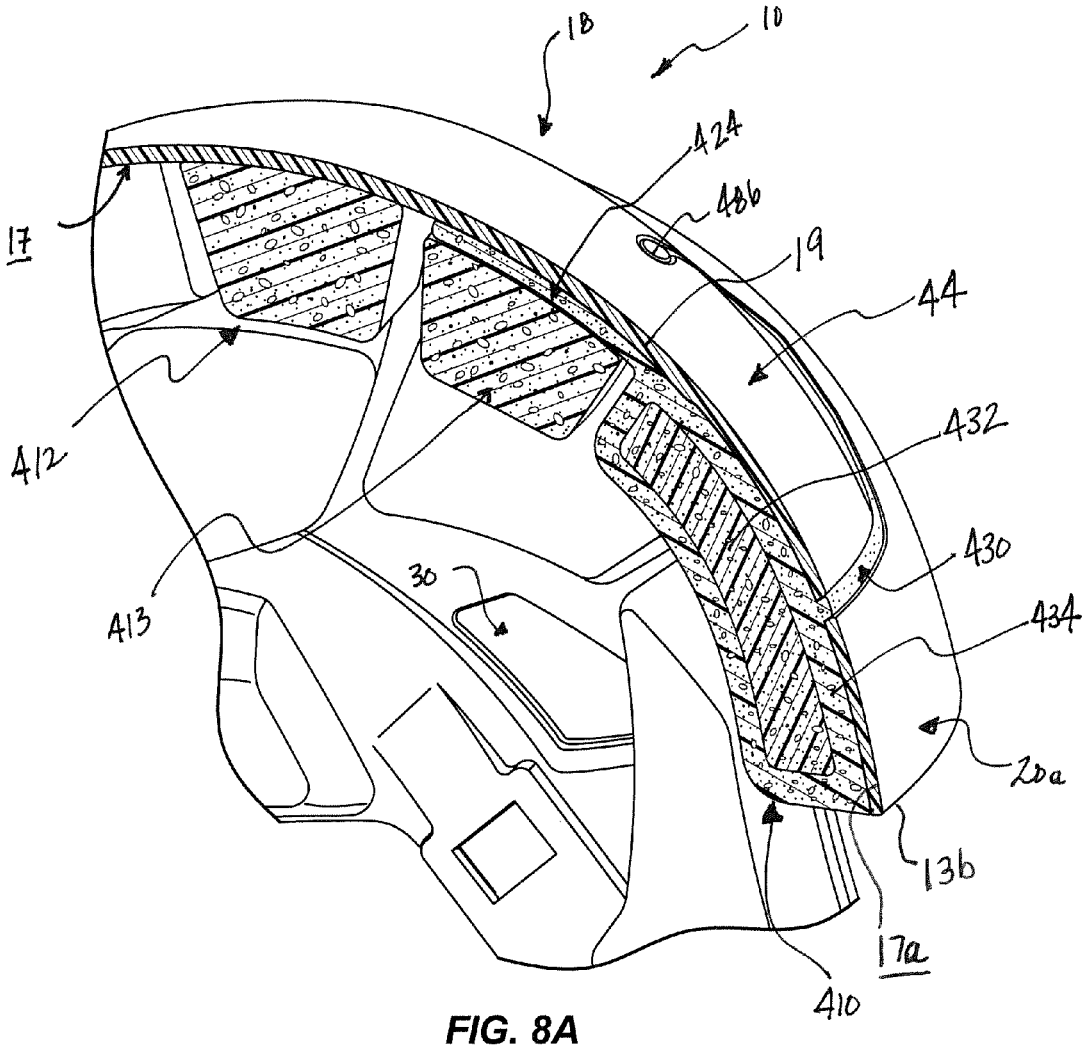
FIG. 8A is a partial cross-section of the impact attenuation system of the football helmet taken along line 8-8 of FIG. 4, showing the helmet in an initial position.
Figure 8B:
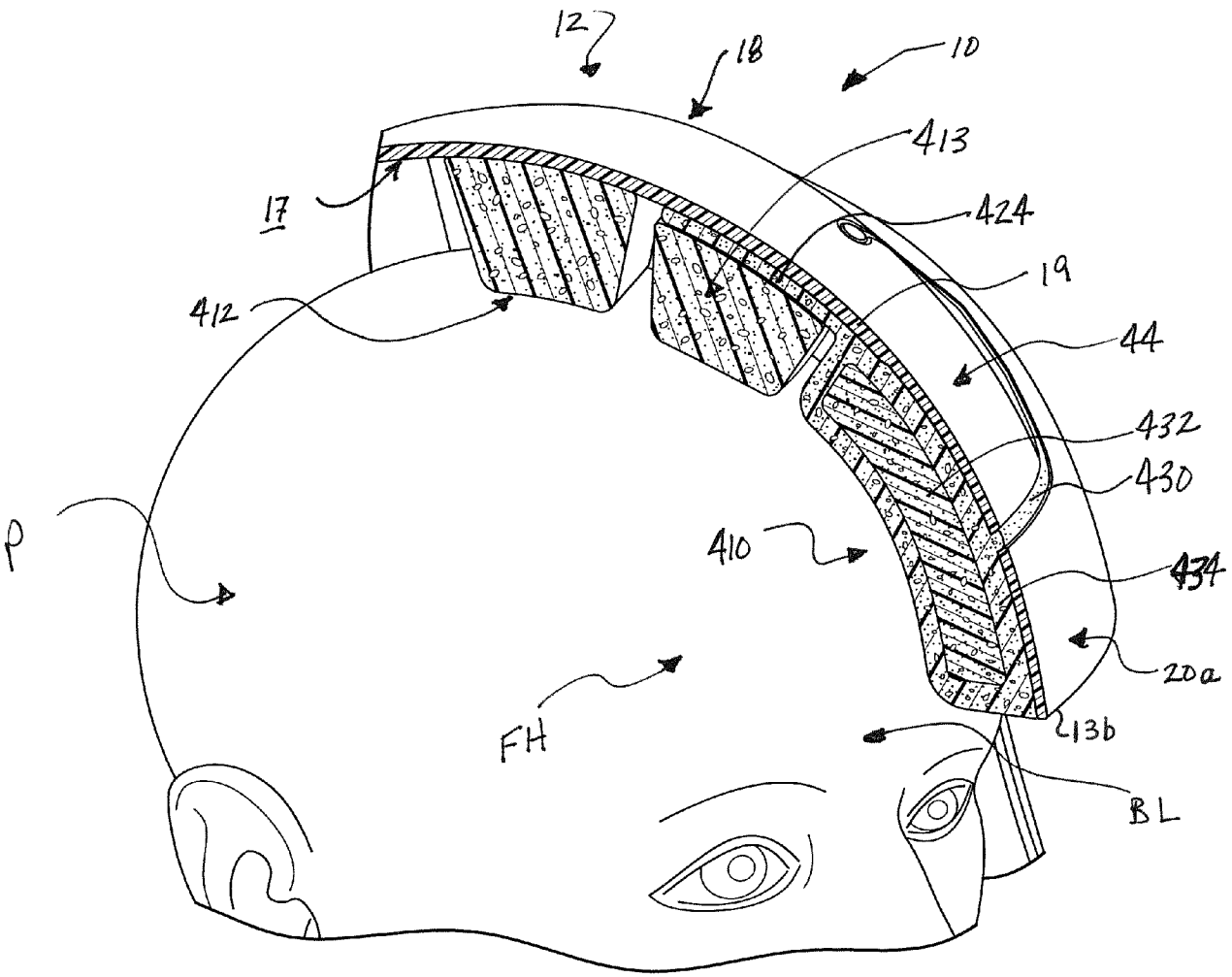
FIG. 8B is a partial cross-section of the impact attenuation system of the football helmet taken along line 8-8 of FIG. 4, showing the helmet worn by player P and in an initial position.

In the embodiment shown in FIGS. 4-6, the raised central band 62 and its sidewalls 66*a,b* extend upward from the distal end 58 across an intermediate portion 59 and then beyond the base 54 of the cantilevered segment 44. In this manner the leading edges of the raised central band 62 and the sidewalls 66*a,b* taper into and are flush with the distal end 58 proximate the lateral segment 49 (see FIG. 6). Alternatively, the leading edges of the raised central band 62 and the sidewalls 66*a,b* are positioned above the distal end 58 and closer to the base 54. In another alternative, the leading edge of the raised central band 62 and the sidewalls 66*a,b* are positioned above the base 54 whereby the raised central band 62 is external to the cantilevered segment 44. As shown in FIGS. 8A,B and 13A,B, the shell 12 also includes an inner central bead 19 formed from material added to the shell 12, wherein the bead 19 extends along the inner shell surface 17 from the crown portion 18 to the cantilevered segment 44. The bead 19 has a rounded nose 19*a* that extends downward past the base 54 to the intermediate portion 59 and towards the distal end 58. Preferably, a major extent of the cantilevered segment 44 has the same wall thickness as the other portions of the front shell portion 20 and the crown portion 18. For example, the intermediate portion 59 and the distal end 58 of the cantilevered segment 44, the front shell portion 20 and the crown portion 18 have a nominal wall thickness of 0.125 inch±0.005 inch. In addition, bosses 53*a,b* are formed on the inner shell surface 17 around the eyelets 48*a,b* to increase the durability of this region of the shell 12 and cantilevered segment 44.

Figure 10:
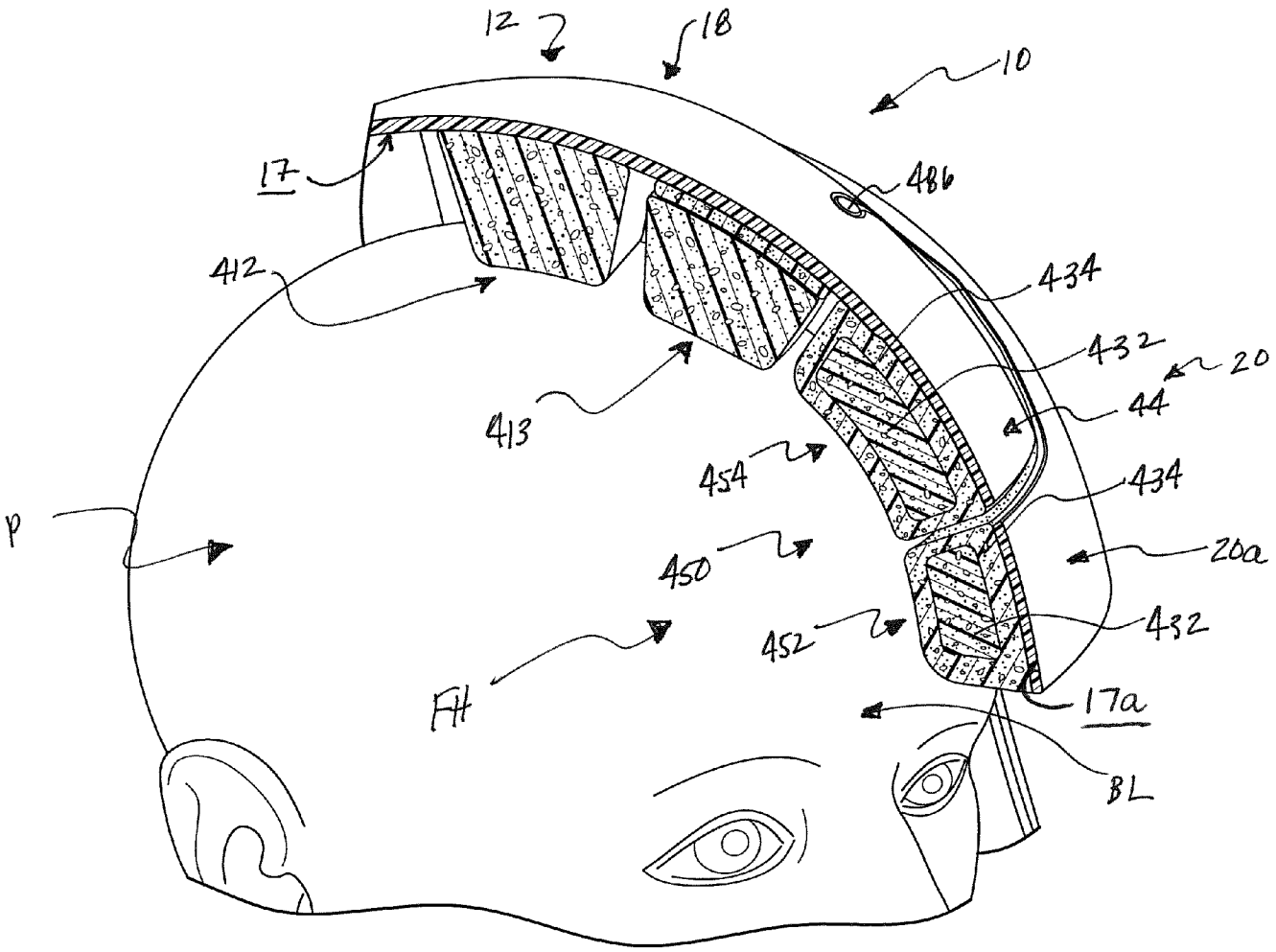
FIG. 10 is a partial cross-section of a first alternative embodiment of the impact attenuation system of the football helmet taken along line 8-8 of FIG. 4, showing the helmet worn by player P and in an initial position.
Figure 11:
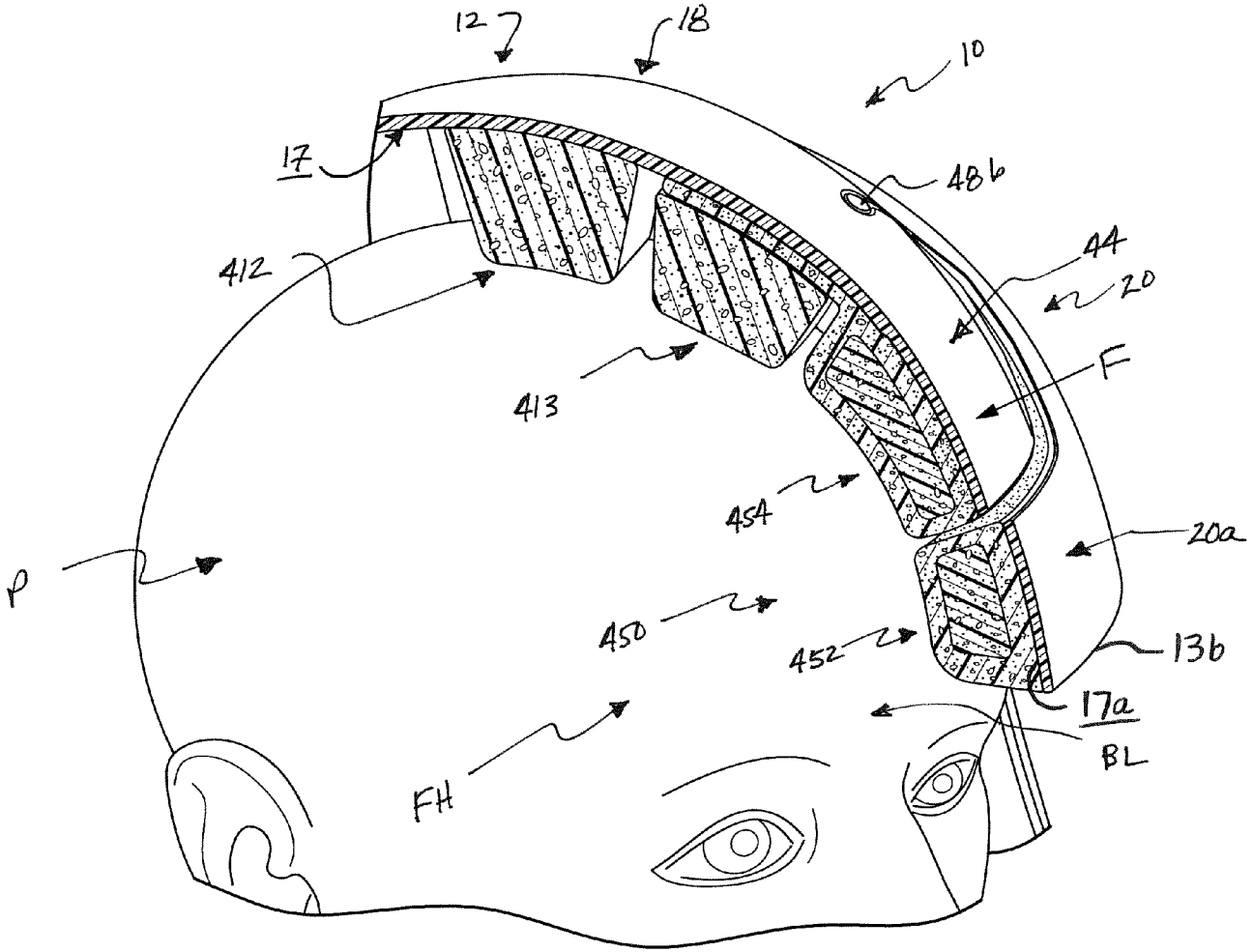
FIG. 11 is a partial cross-section of the first alternative embodiment of the impact attenuation system of the football helmet, showing the helmet worn by player P and in an impact position.
Figure 12:
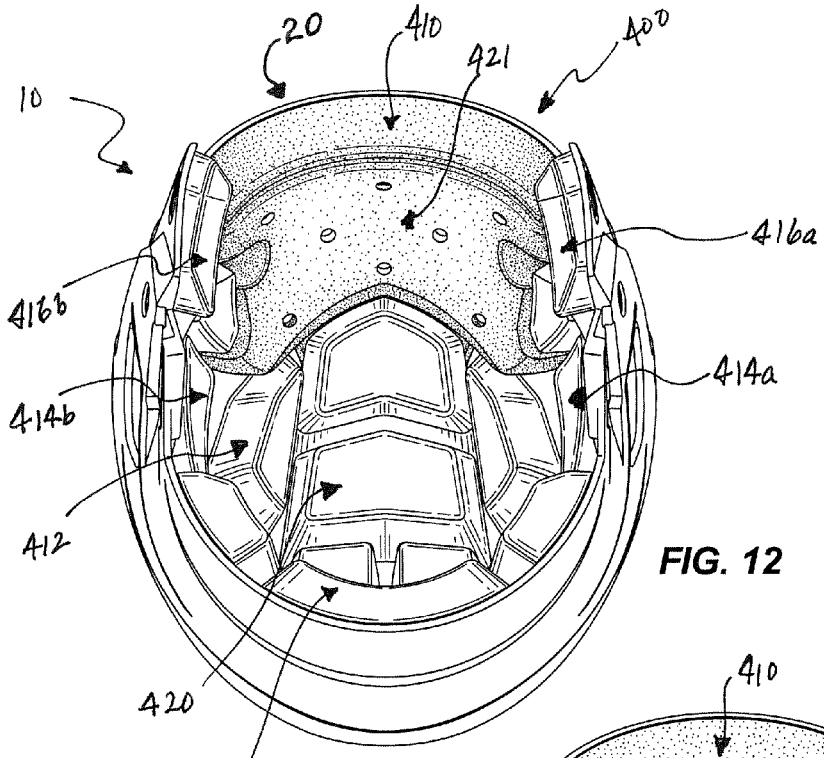
FIG. 12 is a bottom view of the football helmet, showing an internal padding assembly of the helmet.

As shown in FIGS. 8-13, the helmet 10 includes an internal padding assembly 400 with a front pad 410 that structurally and functionally interacts with the impact attenuation member 42. As such, the engineered impact attenuation system 14 comprises both the cantilevered segment 44 and the front pad 410. The internal padding assembly 400 also comprises a crown pad assembly 412, left and right ear flap pad assemblies 414*a,b*, left and right jaw flap pad assemblies 416*a,b*, and rear pad assembly 418. The internal padding assembly 400 also includes a relatively thin, padded overliner 420 that is positioned against the player's P head when the helmet 10 is worn. It is understood that the overliner 420, the crown pad assembly 412, the left and right ear flap pad assemblies 414*a,b*, the left and right jaw flap pad assemblies 416*a,b*, and the rear pad assembly 418 can include a number of distinct pad members formed from one or more energy absorbing materials. FIG. 12 shows these pad components installed within the helmet 10. In FIG. 13B, the overliner 420, the crown pad assembly 412, and the left and right ear flap pad assemblies 414*a,b* are removed to further illustrate the internal layout of the helmet shell 12.

Figure 13A:
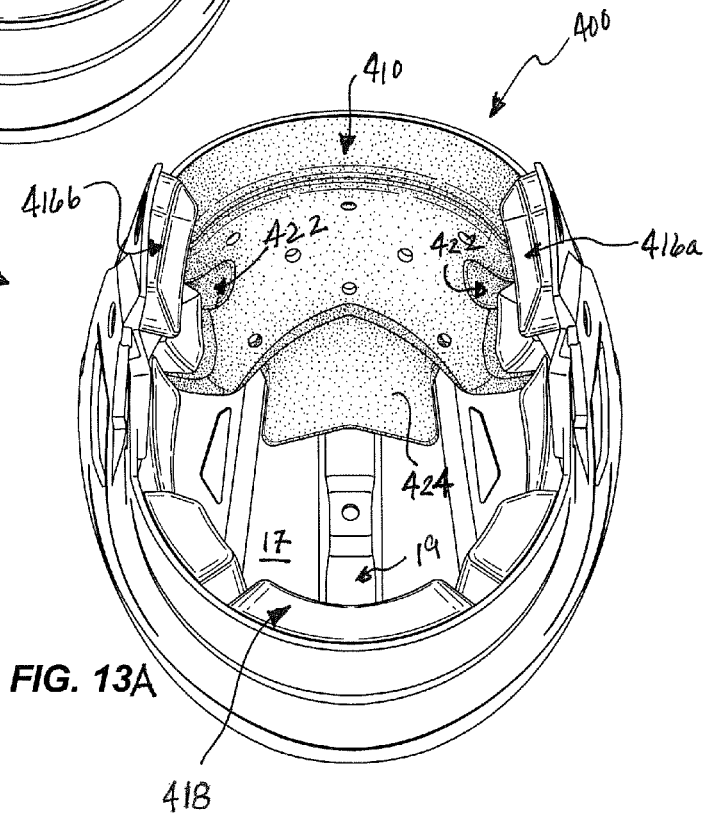
FIG. 13A is a bottom view of the football helmet, showing a portion of the internal padding assembly removed thereby exposing an inner surface of helmet shell.
Figure 13B:
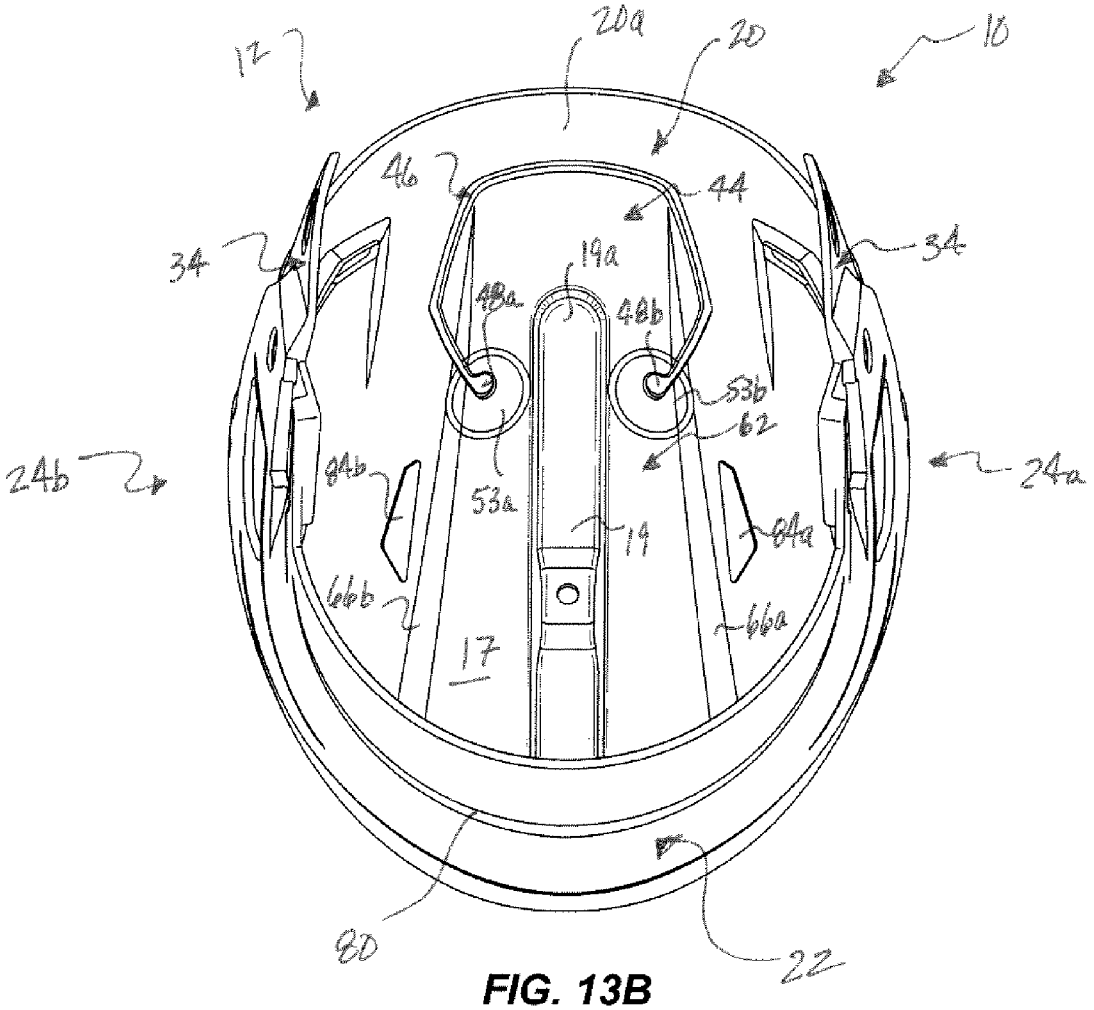
FIG. 13B is a bottom view of the football helmet, showing the entire internal padding assembly removed thereby exposing the inner surface of helmet shell.

As shown in FIGS. 12 and 13A, the front pad 410 has a curvilinear configuration that corresponds to the curvature of the inner surface 17 of the shell 12 and the cantilevered segment 44. Referring to FIGS. 8-11, 12 and 13A, the front pad 410 is secured to the inner shell surface 17 and extends across the front shell portion 20 while underlying the cantilevered segment 44. The front pad 410 also has a recessed central region 421, peripheral recesses 422 that facilitate engagement of the pad 410 with the left and right jaw flap pad assemblies 416*a,b*, and a tab 424 extending from an upper, outer edge of the pad 410. As shown in FIGS. 1 and 8A,B, when the helmet 10 is worn by the player P, the front pad 410 engages the player's frontal bone or forehead FH while extending laterally between the player's temple regions and extending vertically from the player's brow line BL across the player's forehead FH. Referring to FIGS. 8A, B and 12, the tab 424 extends along the inner surface of the crown portion 18 and between a first pad element 413 of the crown pad 412 and the inner surface 17 of the shell 12, wherein the tab 424 is positioned generally above the cantilevered segment 44. When the pad assembly 400 is installed, the tab 424 engages an extent of the bead 19 that extends along the inner shell surface 17. In a preferred embodiment, the tab 424 includes a channel that facilitates engagement of the tab 424 with the bead 19. When the helmet 10 is worn by player P, the tab 424 overlies the coronal suture of the player's head. The front pad 410 also includes means for securing, such as Velcro® or a snap connector, the pad 410 to the inner shell surface 17. As shown in FIGS. 8A,B and 9 an outer surface of the front pad 410 also includes a boss 430 that is received within the gap or opening 46 formed between the cantilevered segment 44 and the lower frontal region 20*a* of the front shell portion 20. Reception of the boss 430 within the gap 46 indicates proper positioning of the front pad 410 relative to the cantilevered segment 44.

To attain the desired energy attenuation properties, a casting process is used to form the front pad 410 which includes an internal pad component 432 and an overmolded external pad component 434. In the embodiment shown in FIGS. 8-13, the internal pad component 432 is formed from vinyl nitrile, preferably VN600, and the external component 434 is formed from urethane. Referring to FIGS. 12 and 13A, the inner surface of the front pad 410 includes a plurality of apertures that receive pins during the casting process to ensure that the internal pad component 432 remains properly positioned relative to the external pad component 434. In one embodiment, the internal pad component 432 includes a central void whereby the central region 421 of the front pad 410 lacks the internal pad component 432. The properties of the vinyl nitrile internal pad component 432 and the urethane external pad component 434 have been separately evaluated. Under the modified ASTM D1056 test standard, the vinyl nitrile internal pad component 432 has been formulated to have 25% compression deflection values of 7.0-17.0 psi (pounds/inch^2), and preferably 8.5-15.5 psi. Under the same test standards, the urethane external pad component 434 has been formulated to have 25% compression deflection values of 15-45 psi (pounds/inch^2), preferably 20-40 psi, and most preferably 30-40 psi. The urethane external pad component 434 also has a hardness value of 40-85, preferably 40-65, and most preferably 45-55 measured with a durometer, after 2 seconds, on the Shore OO scale. The measurements of the urethane external pad component 434 were conducted on a sample in the non-skinned surface state, meaning the outermost skin or film of the sample was not present. At a midpoint of its lower edge, the front pad 410 has a thickness of at least 1 inch, preferably at least 1.125 inch, and most preferably at least 1.25 inch and less than 2.0 inches.

FIGS. 10 and 11 show an alternate front pad 450 comprising a lower pad element 452 residing adjacent the inner shell surface 17 at a lower frontal region 20*a* of the front shell portion 20 below the cantilevered segment 44, and an upper pad element 454 residing adjacent the cantilevered segment 44. The front pad 450 is formed such that the upper pad element 454 can be displaced relative to the lower pad element 452. For example, the front pad 450 can be segmented such that the upper pad element 454 can be displaced inward with the cantilevered segment 44 while the lower pad element 452 remains affixed to the lower frontal region 20*a*. The front pad 450 also includes the tab 424, and each of the lower and upper pad elements 452, 454 include the internal and external pad components 432, 434. Although not shown, the front pad 450 includes a thin webbing or membrane between the lower and upper pad elements 452, 454 that is aligned with the gap 46 of the cantilevered segment 44.

As mentioned above, the impact attenuation system 14 is specifically designed and engineered to adjust how the helmet 10 responds to impact forces by reducing the energy resulting from those impacts. In the embodiment illustrated in FIGS. 1-13, the impact attenuation system 14 provides a cantilevered segment 44 in the front shell portion 20 which, due to its configuration, reduces the structural modulus of this portion 20 compared to the structural modulus of other portions of the helmet shell 12 that lack the impact attenuation member 42, including the cantilevered segment 44. The cantilevered segment 44 and the accompanying reduction of the structural modulus alter and improve the dynamic performance of the front shell portion 20 when an impact force(s) is applied thereto, as compared to adjacent portions lacking the system 14 (such as the left and right side shell portions 24).

Figure 9:
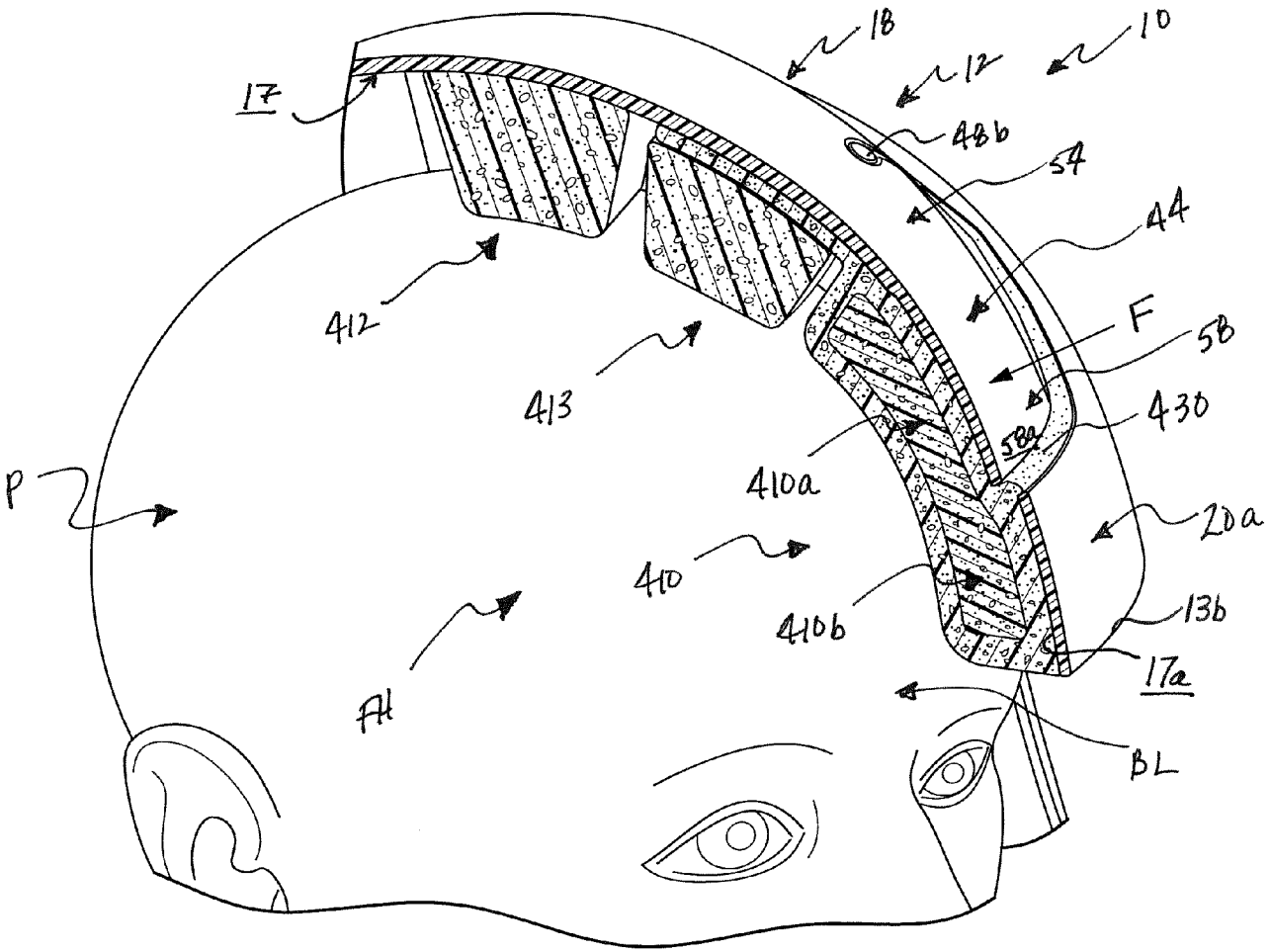
FIG. 9 is a partial cross-section of the impact attenuation system of the football helmet, showing the helmet worn by player P and in an impact position.

FIGS. 9 and 11 show the cross-sectioned helmet 10 being worn by player P and in the impact position. The arrow in these Figures represents the inwardly directed force F resulting from a substantially on-center impact applied normal to the front shell portion 20 on the midsaggital plane that divides the helmet 10 and the player's P head into left and right halves. Referring to FIG. 9, an appreciable impact force F causes the cantilevered segment 44 to elastically deform inward towards the forehead FH of the player P. Specifically, the free end 58 of the segment 44 flexes relative to the base 54 wherein the free end 58 is displaced inward before returning to an initial, pre-impact position shown in FIG. 8B. The extent of the deformation or flex depends upon the severity of the impact force F, including its magnitude, direction and duration, as well as the front pad 410. The front pad 410 is positioned against the players' forehead FH which acts to restrain inward displacement of the front pad 410. Accordingly, the inward displacement of the segment 44 causes an upper portion 410*a* of the front pad 410 to compress while a lower portion 410*b* of the front pad 410 remains substantially uncompressed relative to the upper pad portion 410*a* (see FIG. 9). Therefore, the elastic deformation of the cantilevered segment 44 results in localized compression of the front pad 410, namely the upper pad portion 410*a* as compared to the lower pad portion 410*b*. Depending upon the nature of the impact force F, the boss 430 remains substantially within the gap 49. In the helmet embodiment of FIGS. 8 and 9, an inwardly directed normal force (oriented substantially similar to the arrow F in these Figures) of 3 pounds, as measured with a force gauge having a point loader, applied on-center to the cantilevered segment 44 causes the cantilevered segment 44 to elastically deform inward 0.125 inch, where the front pad 410 has been removed from the helmet 10. In contrast, an inwardly directed normal force of 3 pounds applied to other portions of the shell 12 will not result in the 0.125 inch elastic deformation experienced by the cantilevered segment 44. To obtain the same 0.125 inch elastic deformation in a region of the shell 12 lacking the impact attenuation system 14, the inwardly directed normal force is significantly higher. For example, to attain 0.125 inch of deformation of the shell 12 adjacent the frontal opening 90*a,b*, the inwardly directed normal force is at least 30 pounds, again where the front pad 410 has been removed from the helmet 10. One of skill in the art of designing football helmets recognizes that an inwardly directed normal force much greater than 3 pounds is required to elastically deform the cantilevered segment 44 inward 0.125 inch when the front pad 410 is properly installed in the helmet 10.

When the impact force F is significant and results from a substantially on-center frontal impact to the front shell portion 20, the free end 58 of the cantilevered segment 42 is displaced inward of the lower frontal region 20*a*. Also, the outer surface 58*a* of the free end 58 is positioned inward of the inner shell surface 17*a* at the lower frontal region 20*a* of the front shell portion 20 (see FIG. 9). However, the lower frontal region 20*a* and the other portions of the shell 12, including the crown portion 18 and the left and right side portions 24, do not elastically deform or flex in a manner similar to the cantilevered segment 44. In response to the significant impact force F that causes inward displacement of the segment 44, the upper pad portion 410*a* elastically compresses approximately 0.125 inch in thickness, while the lower pad portion 410*b* remains substantially uncompressed. The compression of the front pad 410 reduces or attenuates the energy associated with the impact force F and improves the overall performance of the internal pad assembly 400, which provides a benefit to the player P. When the helmet 10 was tested in accordance with the NOCSAE standard ND002 for newly manufactured football helmets (available online at http://nocsae.org/standards/football/) under the standard range of impact velocities, the helmet 10 reduces frontal impact severity by at least 5%, as measured by the Severity Index, compared to a conventional helmet lacking the impact attenuation system 14.

Referring to FIGS. 10 and 11, the alternate front pad 450 behaves in a similar manner in response to the inwardly directed force F resulting from an impact applied normal to the front shell portion 20. The significant impact force F causes the cantilevered segment 44 to elastically deform inward towards the forehead FH of the player P. The front pad 450 is positioned against the players' forehead FH which acts as a barrier to restrict inward displacement of the front pad 450. Accordingly, the inward displacement of the segment 44 causes the upper pad element 454 to compress while the lower pad element 452 remains substantially uncompressed. Therefore, the elastic deformation of the cantilevered segment 44 results in compression of upper pad element 454 while other regions of the front pad 450, including the lower pad element 452, are not affected by the deformation of the segment 44. Under the significant impact force F, the upper pad element 454 elastically compresses approximately 0.125 inch in thickness.

Figure 14:
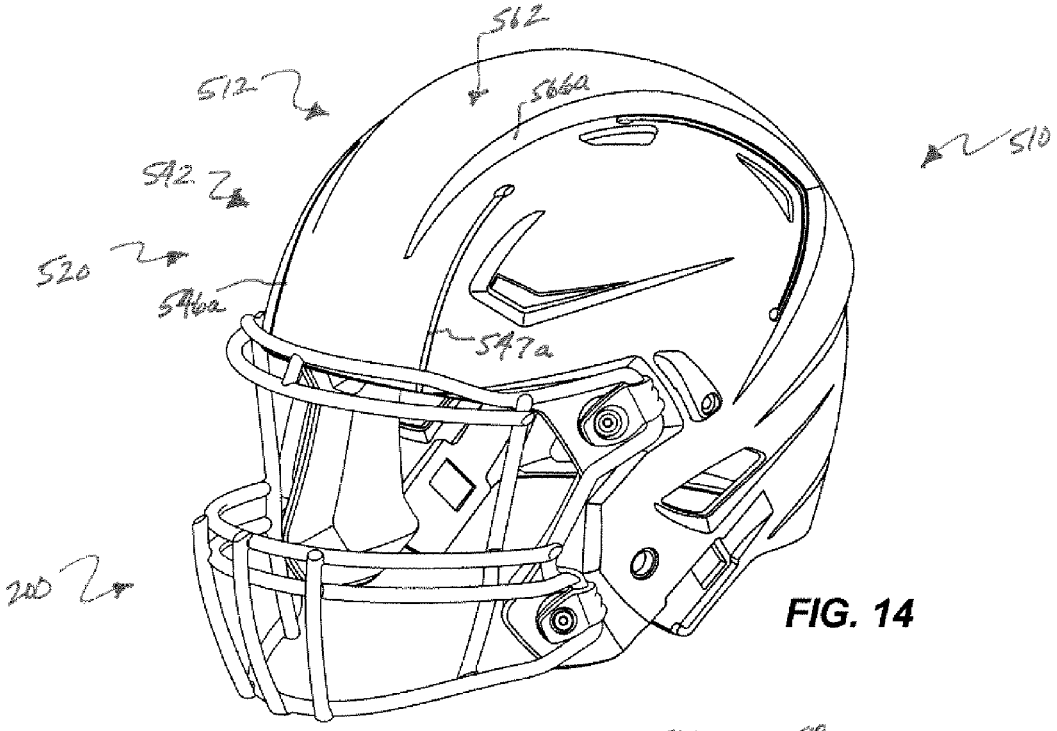
FIG. 14 is a front perspective view of a second alternative embodiment of the football helmet.
Figure 15:
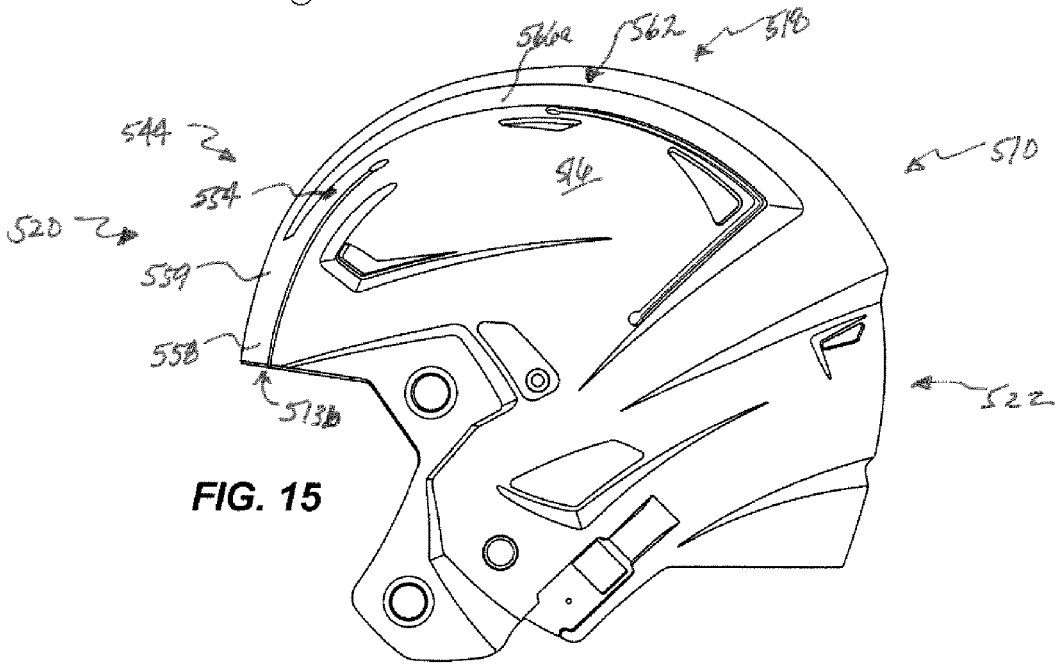
FIG. 15 is a left side view of the football helmet of FIG. 14.
Figure 16:
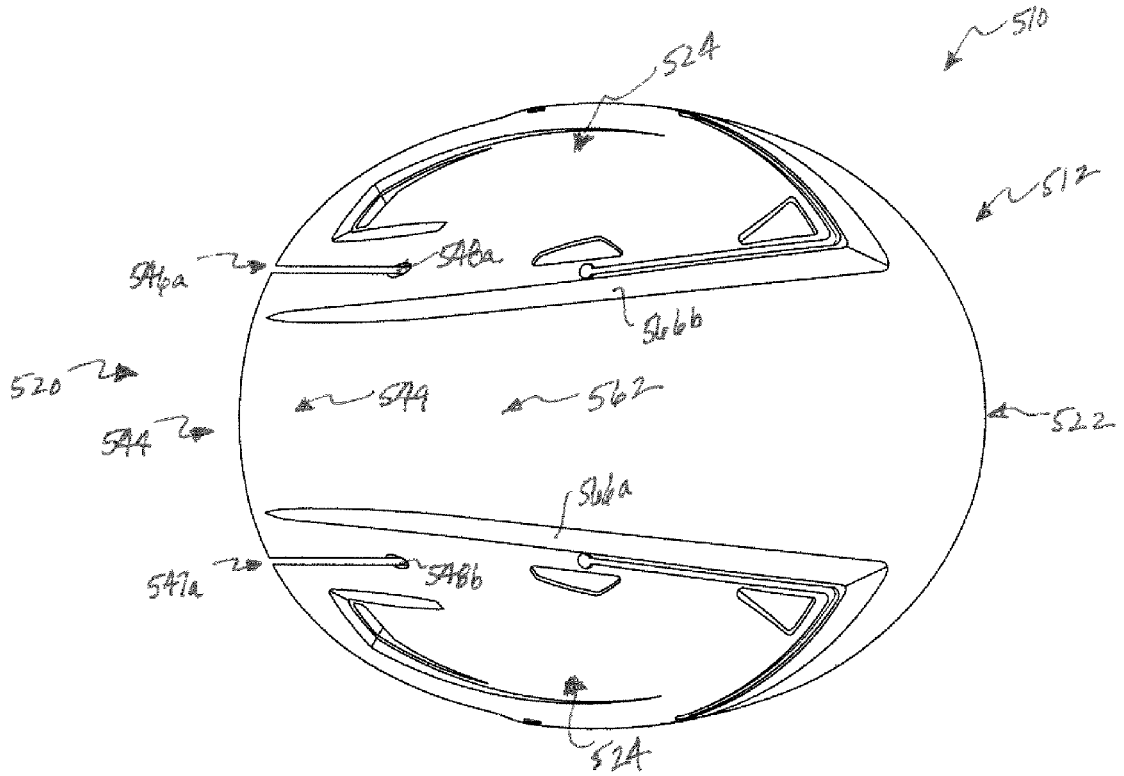
FIG. 16 is a top view of the football helmet of FIG. 14.

FIGS. 14-16 show an alternate helmet 510 with a larger impact attenuation member 542 provided as cantilevered segment 544 that consumes a majority of the front shell portion 520. The cantilevered segment 544 includes a base 554 and a distal free end 558, and approximates the behavior of a living hinge when a substantially frontal impact is received by the front shell portion 520. Unlike the cantilevered segment 44, the free end 558 is positioned at the central frontal edge 513*b* in the front shell portion 520. The cantilevered segment 546 is defined by a gap or opening 546 formed in the front shell portion 20. A generally vertical right gap segment 546*a* extends downward from a right end point 548*a* to the central frontal edge 513*b*. A generally vertical left gap segment 547*a* extends downward from a left end point 548*b* to the central frontal edge 513*b*. Preferably, the right and left segments 546*a*, 547*a* are substantially parallel. The raised central band 562 and its sidewalls 566*a,b* extend upward from an intermediate portion 549 and then beyond the base 554 of the cantilevered segment 44. In this manner the leading edges of the raised central band 562 and the sidewalls 566*a,b* taper into and are flush with the intermediate portion 559. Preferably, the leading edges of the raised central band 562 and its sidewalls 566*a,b* reside within the right and left segments 546*a*, 547*a*. The impact attenuation member 542 and the front pad 410 function and respond to impacts in substantially the same manner as described above for the impact attenuation member 42. Because the impact attenuation member 542 has a larger cantilevered segment 544 there is typically a larger extent of localized compression of the front pad 410 due to elastic deformation of the segment 544 than that experienced during elastic deformation of the smaller cantilevered segment 544.

FIGS. 17-21 show an alternate helmet 610 with an impact attenuation member 642 provided as a separate panel 644, meaning that the panel 644 is distinct structure formed separately from the shell 612. However, the panel 644 is inserted into an opening 613 pre-formed in the front shell portion 620 and then retained in a use position P1 when the helmet 610 is worn by the player P and during the course of play. In that regard, the panel 644 functions as an integral part of the shell 612 when the helmet 610 is worn by the player P during the course of play. However, the panel's 644 response to impacts is not restricted by the shell 612. In this manner, the impact response behavior of the panel 644 is not impeded by the impact response behavior of the shell 612. When the panel 644 is positioned within the opening 613, the panel 644 and the front shell portion 620 define a gap or opening 646 extending along the perimeter of the panel 644. Unlike the two impact attenuation members 42, 542 discussed above, the panel 644 is not cantilevered and does not behave as a living hinge in response to helmet impact forces. The panel 644 is operably positioned in the opening 613 which is positioned a distance above the central frontal edge 613*b* wherein that distance is defined by a lower frontal region 620*a* of the front shell portion 620. The panel 644 may be formed of the same material as the remainder of the shell 612 or of a different material. For example, the panel 644 may be formed from a material to provide the panel 644 with a lower or higher structural modulus than that of the remaining shell 612. Although the helmet 610 is shown to have only one impact attenuation member 642, the helmet 610 can be configured with multiple members 642. For example a second panel 644 can be configured in the rear shell portion 622, the crown portion 618 or the side portions 624.

Figure 17:
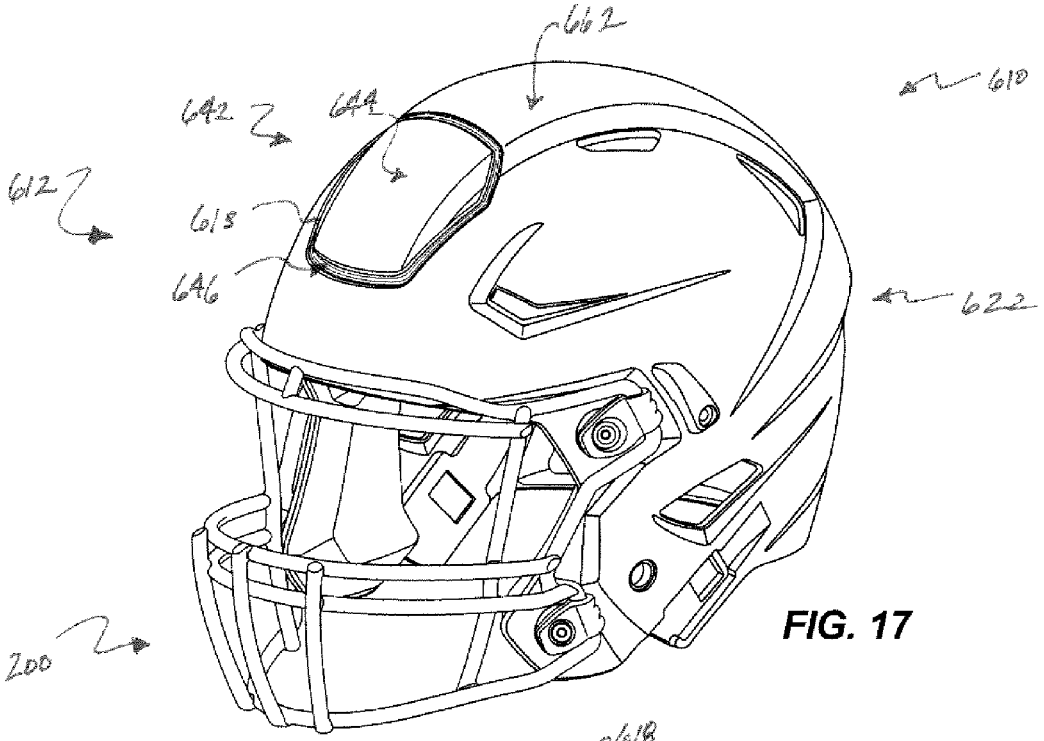
FIG. 17 is a front perspective view of a third alternative embodiment of the football helmet.
Figure 18:
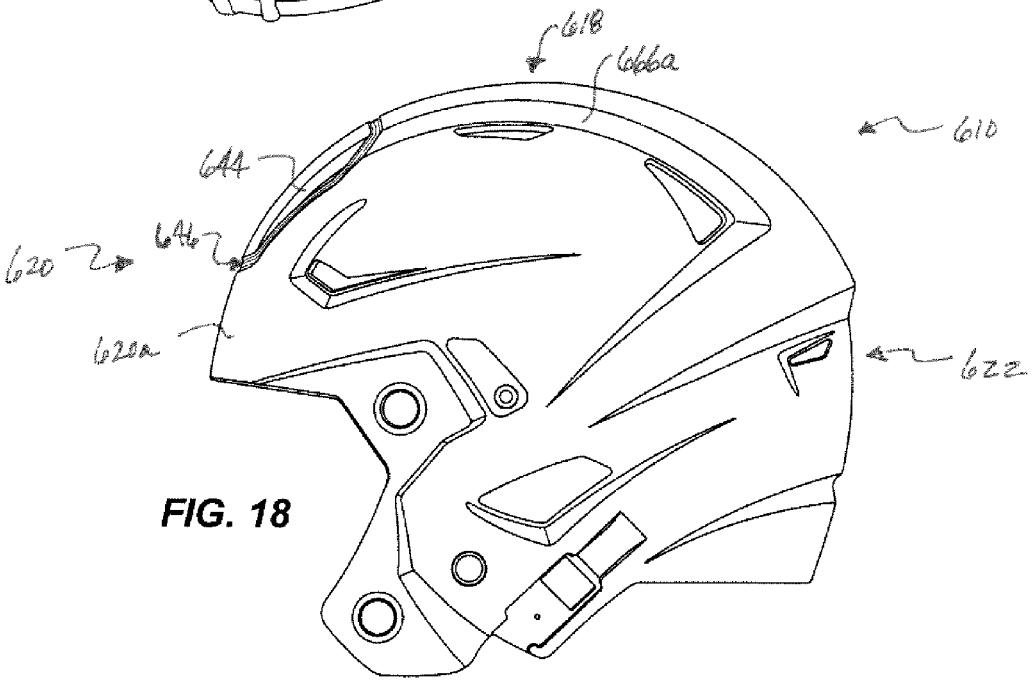
FIG. 18 is a left side view of the football helmet of FIG. 17.
Figure 19:
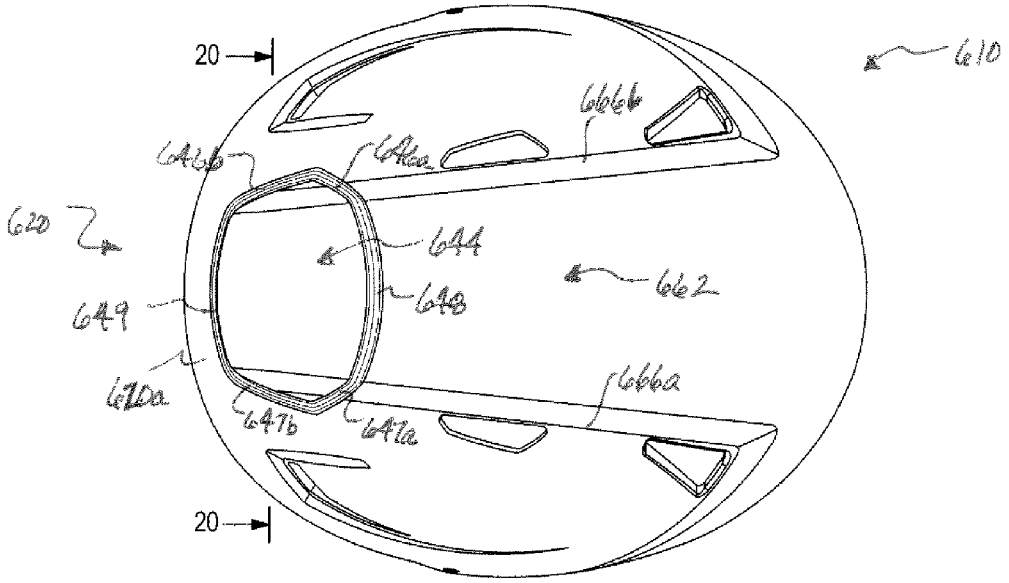
FIG. 19 is a top view of the football helmet of FIG. 17.

As shown in FIGS. 17 and 19, the panel 644 results in the gap 646 having six sides wherein a first generally vertical right segment 646*a* extends downward and outward from an upper lateral segment 648 towards the right side of the front shell portion 620. A second generally vertical right segment 646*b* extends downward and inward from the first right segment 646*a* to a lower lateral segment 649. Similarly, a first generally vertical left segment 647*a* extends downward and outward from the upper lateral segment 64 towards the left side of the front shell portion 620. A second generally vertical left segment 647*b* extends downward and inward from the first left segment 647*a* to the lower lateral segment 649. Thus, the lateral segments 648, 649 extend between the second right and left segments 646*a,b* and 647*a,b*. Although the illustrated first and second segments 646*a,b* and 647*a,b* and the upper and lower lateral segments 648, 649 are substantially linear, these segments can be configured as curvilinear or a combination of curvilinear and straight segments. Furthermore, the panel 644 and the resulting gap 646 may be formed with more or less than the six segments shown, for example, with three segments whereby the panel 644 has a triangular configuration or with four segments whereby the panel 644 has a rectangular configuration. In another embodiment, the panel 644 and the gap 646 have a circular or elliptical configuration. In the embodiment shown in FIGS. 17-21, the raised central band 662 and its sidewalls 666*a,b* extend upward from a lower panel portion 658 across an intermediate panel portion 659 and then beyond an upper panel portion 654. In this manner the leading edges of the raised central band 662 and the sidewalls 666*a,b* taper into and are flush with the lower panel portion 658.

Figure 21:
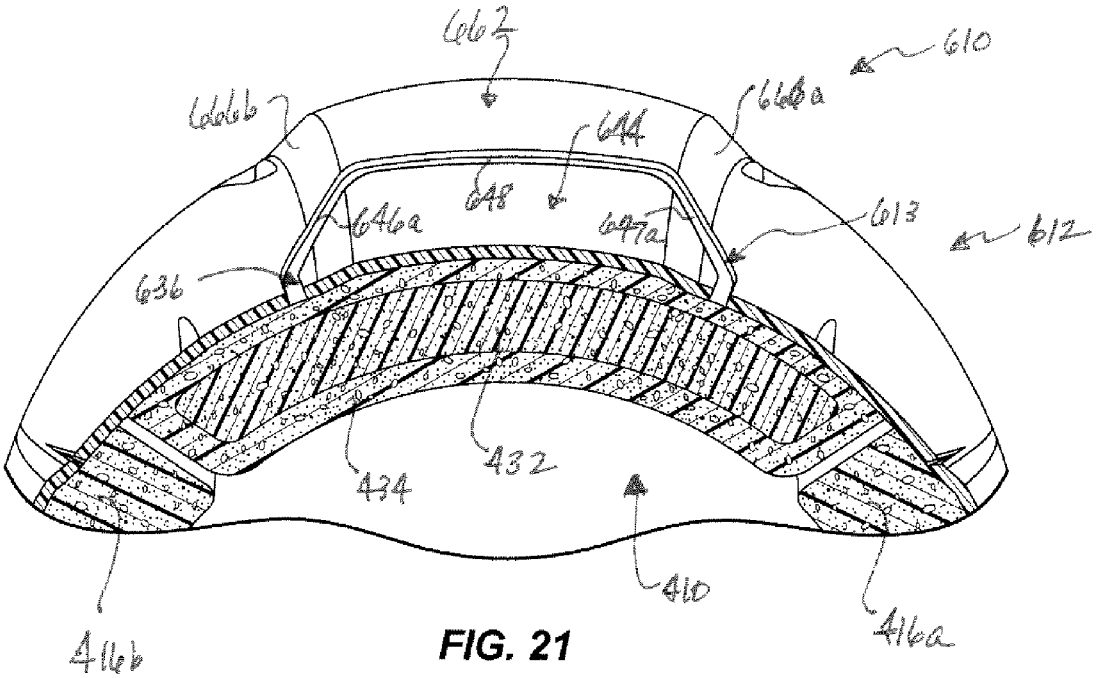
FIG. 21 is a partial cross-section of the football helmet of FIG. 17, showing an alternate internal padding assembly.
Figure 22:
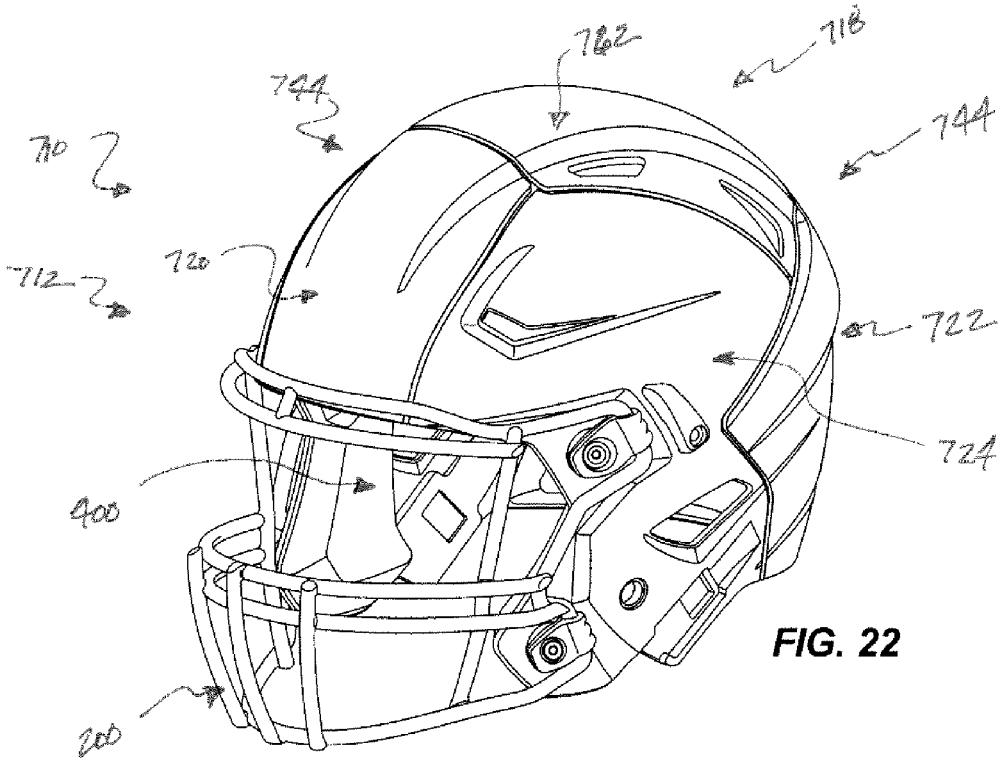
FIG. 22 is a front perspective view of a fourth alternative embodiment of football helmet.
Figure 23:
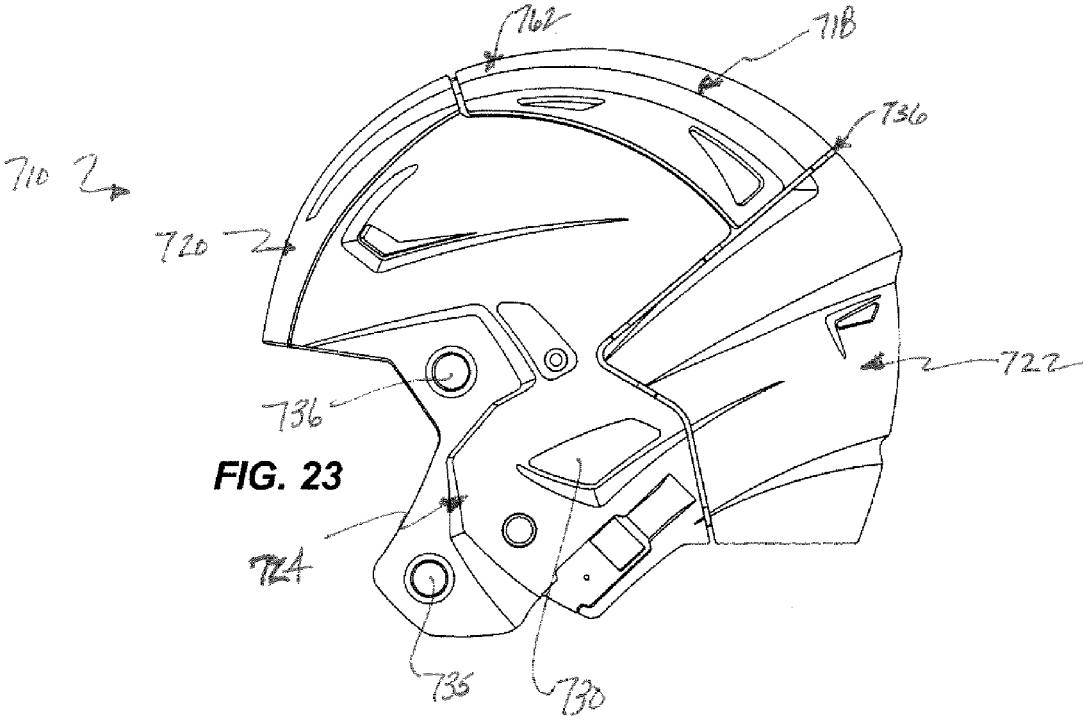
FIG. 23 is a left side view of the football helmet of FIG. 22.
Figure 24:
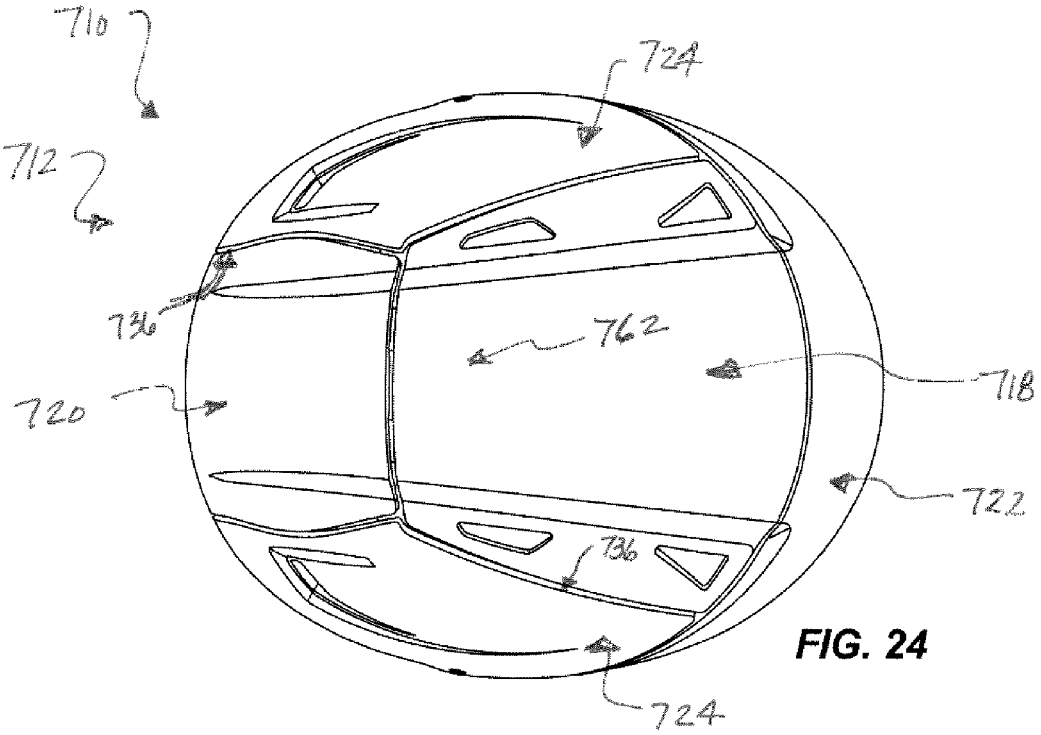
FIG. 24 is a top view of the football helmet of FIG. 22.

Referring to FIG. 21, the panel 644 is inserted into the opening 613 and operably connected to the front pad 410 which is secured to the inner shell surface 617. Although not shown, the front pad 410 can include the boss 430 that extends upward into the gap 646. Alternatively, a flexible material or thin film can be positioned within the gap 646. The impact attenuation member 642, namely the panel 642, and the front pad 410 function and respond to impacts in substantially the same manner as described above for the impact attenuation member 42. Therefore, localized compression of the front pad 410 occurs when the panel 644 is elastically displaced inward by force F resulting from a substantially frontal impact. However, the deformation of the panel 644 is not influenced by the living hinge of the cantilevered segment 44 because it is absent from the impact attenuation member 642.

Figure 20:
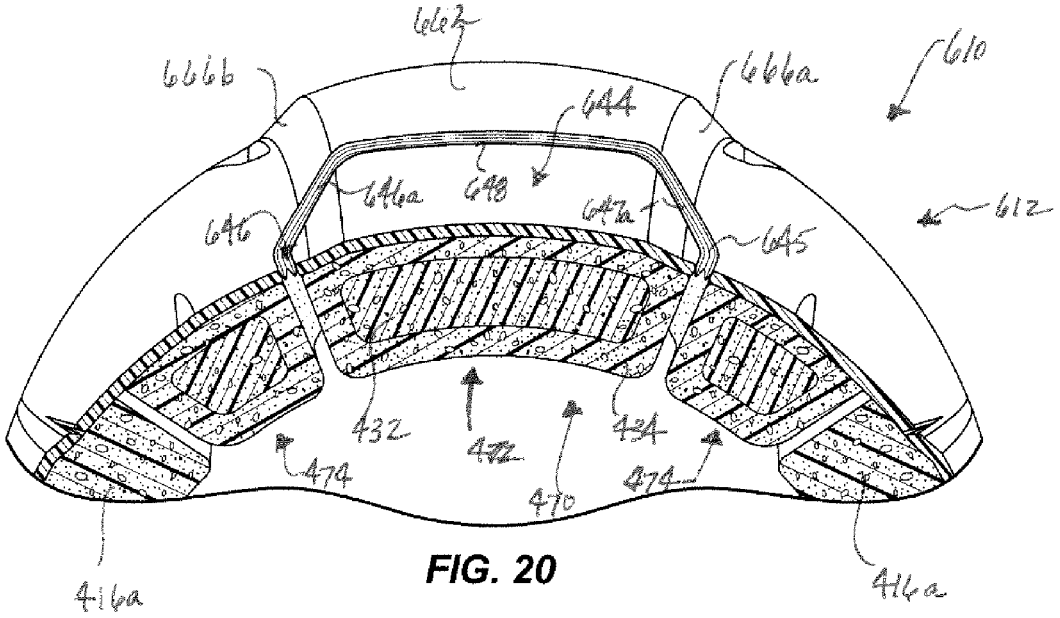
FIG. 20 is a partial cross-section of the football helmet of FIG. 17, taken along line 20-20 of FIG. 19.

FIG. 20 shows an alternate version of the impact attenuation member 642 wherein the panel 644 is operably connected to shell 612 by a flexible matrix of material or film 645 that resides within the gap 646. An alternate front pad member 470 is affixed to the inner surface 617 of the shell 612 and includes an intermediate pad member 472 that is distinct from and is positioned between opposed outer pad members 474. The outer pad members 474 are positioned adjacent the upper portions of the jaw pads 416*a,b*. The intermediate pad member 472 and the outer pad members 474 include the internal pad component 432 and the external pad component 434. The panel 644 is operably connected to the intermediate pad member 472 while the outer pad members 474 are secured to the inner shell surface 617 but not the panel 644. As a result, impact attenuation member 642 and the intermediate pad member 472 respond to impacts in substantially the same manner as described above for the impact attenuation member 42. Nearly the entire intermediate pad member 472 experiences compression when a significant impact force is applied to the front shell portion 620, including panel 644.

Figure 25:
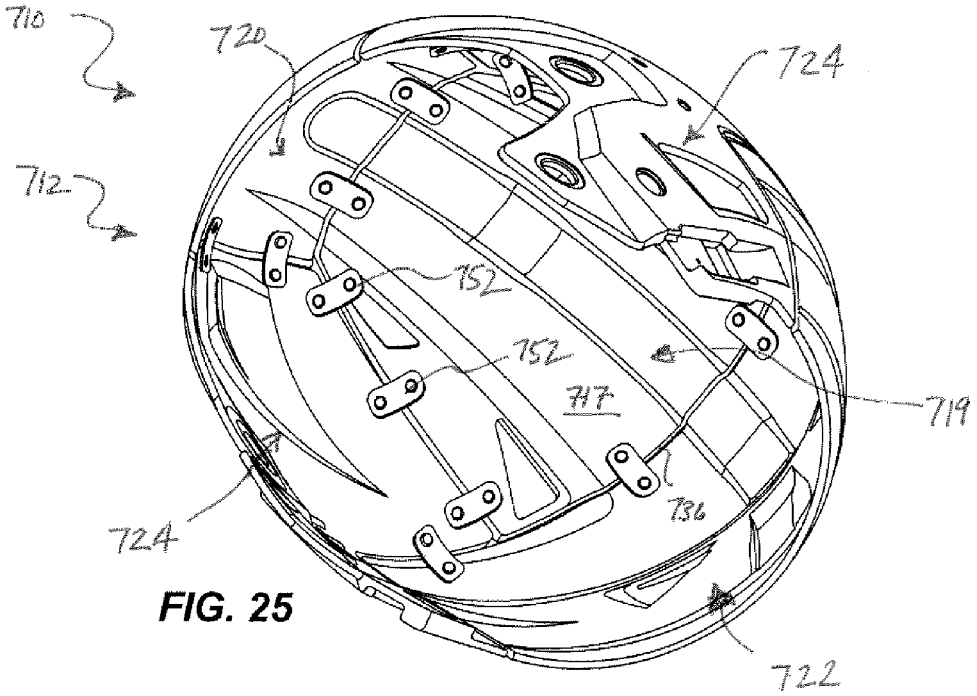
FIG. 25 is bottom view of the football helmet of FIG. 22, showing the internal assembly of the helmet and omitting the internal padding assembly.

FIGS. 22-25 show an alternate helmet 710 with a plurality of impact attenuation members 742 provided as distinct segments 744 operatively connected to form a composite shell 712. The helmet 710 includes an internal padding assembly 400, but it is only shown in FIG. 22. In this manner, the segments 744 are structurally and functionally coupled together to form the shell 712. The attenuation members 744 include a front segment 720, a crown segment 718, a rear segment 722 and left and right segments 724. The left and right segments 724 depend downward from the crown segment 718 and extend laterally between the front segment 720 and the rear segment 722. The left and right segments 724 include the face guard attachment regions 735, 736 and the ear hole 730. Referring to FIG. 25, the front segment 720, crown segment 718, rear segment 722 and left and right segments 724 are operably connected at multiple locations by means for coupling. Coupling means 750 can be a strap and fastener arrangement 752 affixed to the inner surface 717 of the helmet 710. The strap and fastener arrangement 752 provides durable and flexible connection of the segments 744 which enables adjacent segments 744 to flex with respect to each other in response to an impact force. Coupling means 750 can alternatively include a flexible thin film or adhesive substrate that forms an inner support sub-structure for the segments 744. The inner surface 717 of the helmet 710 can include recesses that receive the strap and fastener arrangement 752. The seam where adjacent segments 744 are coupled defines a gap or opening 736. The gap 736 can be minimized during an impact to the helmet 710, however, in the post-impact state the gap 736 is maintained by coupling means 750.

When the helmet 710 is worn by the player P and when an impact force is applied to the front shell segment 720, the front pad assembly 410 is compressed, as discussed above, to attenuate the impact force. However, the crown segment 718, rear segment 722 and left and right segments 724 are generally isolated from the impact force and their respective internal pad members remain substantially uncompressed. As another example, when an impact force is applied to the left shell segment 724, the left side pad assembly 414*a* is compressed but the front segment 720, crown segment 718, rear segment 722 and right segment 724 are generally isolated from the impact force and their respective internal pad members remain substantially uncompressed. Finally, when an impact force is applied to both the crown segment 718 and the left shell segment 724, an extent of both the crown pad 412 and the left side pad assembly 414*a* are compressed. However, the front segment 720, rear segment 722 and right segment 724 are generally isolated from the impact force and their respective internal pad members remain substantially uncompressed. Accordingly, the multiple segments 744 that are operably connected to form the shell 712 enable the helmet 710 to essentially isolate impact forces to those segments 744 upon which the impact was received and their corresponding internal pad members.

It is to be understood that the invention is not limited to the exact details of construction, operation, exact materials or embodiments shown and described, as obvious modifications and equivalents will be apparent to one skilled in the art; for example, the entire cantilever strap could be provided with a shock absorbing pad disposed upon its lower surface. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying claims.

What is claimed is:

1. A football helmet to be worn by a player while playing football, the helmet comprising:

a one-piece shell including:

a crown portion defining an upper region of the shell;

a front portion extending generally forwardly and downwardly from the crown portion;

left and right side portions extending generally downwardly and laterally from the crown portion, each of the left and right side portions having an ear flap configured to overlie an ear of the player wearing the helmet;

a rear portion extending generally rearwardly and downwardly from the crown portion; and, an impact attenuation member formed in an extent of the front portion by removing material from the front portion, the impact attenuation member having a base and a free end extending downward from the base and terminating above a lower frontal edge of the shell, wherein the impact attenuation member changes how the front portion responds to an impact force applied substantially normal to the front portion as compared to how the left and right side portions respond to said impact force.

2. The football helmet of claim 1, wherein the impact attenuation member is a cantilevered segment in the front portion of the shell.

3. The football helmet of claim 2, wherein a periphery of the cantilevered segment is defined by a continuous gap formed in the front portion of the shell.

4. The football helmet of claim 3, wherein the base is a living hinge to facilitate elastic deformation of the cantilevered segment when impact forces are applied to the front portion of the shell.

5. The football helmet of claim 3, wherein the cantilevered segment and the continuous gap have a U-shaped configuration.

6. The football helmet of claim 2, wherein the cantilevered segment is elastically displaced inward toward the helmet wearer when said impact force is applied to the front portion of the shell.

7. The football helmet of claim 2, further comprising a front pad secured to an inner surface of the helmet and extending across a majority of the front portion of the shell and underlying the cantilevered segment, wherein said impact force applied to the front portion causes the cantilevered segment to elastically deform and compress a first portion of the front pad while a second portion of the front pad remains substantially uncompressed.

8. The football helmet of claim 7, wherein the front pad includes an internal pad component and an overmolded external pad component.

9. The football helmet of claim 2, wherein the front portion of the shell includes a pair of front vent openings, and wherein the cantilevered segment is positioned between the front vent openings.

10. The football helmet of claim 1, wherein the front portion of the shell includes a lower frontal shell region that is positioned between the impact attenuation member and the lower frontal edge of the shell, and wherein the lower frontal shell region is not displaced inward when said impact force is applied to the front portion of the shell.

11. The football helmet of claim 10, wherein the free end of the impact attenuation member is displaced inward of the lower frontal shell region when said impact force is applied to the front portion of the shell.

12. The football helmet of claim 1, wherein the front portion of the shell includes a lower frontal shell region and the impact attenuation member is a cantilevered segment, and wherein the lower frontal shell region is positioned between the cantilevered segment and the lower frontal edge of the shell, and wherein the lower frontal shell region is not displaced inward when said impact force is applied to the front portion of the shell.

13. The football helmet of claim 12, wherein the free end of the cantilevered segment is displaced inward of the lower frontal shell region when said impact force is applied to the front portion of the shell.

14. The football helmet of claim 1, further comprising a protective face guard coupled to the shell.

15. A protective sports helmet wearable by a player while playing a contact team sport, the helmet comprising:

a one-piece shell including:

a crown portion defining an upper region of the shell;

a front portion extending generally forwardly and downwardly from the crown portion;

left and right side portions extending generally downwardly and laterally from the crown portion, each of the left and right side portions having an ear flap configured to overlie an ear of the player wearing the helmet;

a rear portion extending generally rearwardly and downwardly from the crown portion; and, an impact attenuation member formed in an extent of the front portion by removing material from the front portion, the impact attenuation member having a base and a free end extending downward from the base and terminating above a lower frontal edge of the shell, wherein the impact attenuation member changes how the front portion responds to an impact force applied substantially normal to the front portion as compared to how the left and right side portions respond to said impact force.

16. The helmet of claim 15, wherein the impact attenuation member is a cantilevered segment in the front portion of the shell.

17. The helmet of claim 16, wherein a periphery of the cantilevered segment is defined by a continuous gap formed in the front portion of the shell.

18. The helmet of claim 17, wherein the base is a living hinge to facilitate elastic deformation of the cantilevered segment when impact forces are applied to the front portion of the shell.

19. The helmet of claim 17, wherein the cantilevered segment and the continuous gap have a U-shaped configuration.

20. The helmet of claim 16, wherein the cantilevered segment is elastically displaced inward toward the helmet wearer when said impact force is applied to the front portion of the shell.

21. The helmet of claim 16, further comprising a front pad secured to an inner surface of the helmet and extending across a majority of the front portion of the shell and underlying the cantilevered segment, wherein said impact force applied to the front portion causes the cantilevered segment to elastically deform and compress a first portion of the front pad while a second portion of the front pad remains substantially uncompressed.

22. The helmet of claim 21, wherein the front pad includes an internal pad component and an overmolded external pad component.

23. The helmet of claim 16, wherein the front portion of the shell includes a pair of front vent openings, and wherein the cantilevered segment is positioned between the front vent openings.

24. The helmet of claim 15, wherein the front portion of the shell includes a lower frontal shell region that is positioned between the impact attenuation member and the lower frontal edge of the shell, and wherein the lower frontal shell region resists inward displacement when said impact force is applied to the front portion of the shell.

25. The helmet of claim 24, wherein the free end of the impact attenuation member is displaced inward of the lower frontal shell region when said impact force is applied to the front portion of the shell.

26. The helmet of claim 15, wherein the front portion of the shell includes a lower frontal shell region and the impact attenuation member is a cantilevered segment, and wherein the lower frontal shell region is positioned between the cantilevered segment and the lower frontal edge, and wherein the lower frontal shell region resists inward displacement when said impact force is applied to the front portion of the shell.

27. The helmet of claim 26, wherein the free end of the cantilevered segment is displaced inward of the lower frontal shell region when said impact force is applied to the front portion of the shell.

28. The helmet of claim 15, further comprising a protective face guard coupled to the shell.

29. A football helmet wearable by a player while playing football, the helmet comprising:

a one-piece shell including:

a crown portion defining an upper region of the shell;

a front portion extending generally forwardly and downwardly from the crown portion;

left and right side portions extending generally downwardly and laterally from the crown portion, each of the left and right side portions having an ear flap configured to overlie an ear of the player wearing the helmet;

a rear portion extending generally rearwardly and downwardly from the crown portion; and, a cantilevered segment formed in the front portion of the shell, the cantilevered segment including a base and a free end, wherein the base functions as a living hinge to facilitate elastic deformation of the cantilevered segment when impact forces are applied to the front portion of the shell, wherein the free end extends downward from the base and terminates above a lower frontal edge of the shell, and wherein the cantilevered segment is elastically displaced inward toward the helmet wearer when a substantially on-center impact force is applied to the front portion of the shell.

30. The helmet of claim 29, wherein a periphery of the cantilevered segment is defined by a continuous gap formed in the front portion of the shell.

31. The helmet of claim 30, wherein the cantilevered segment and the continuous gap have a U-shaped configuration.

32. The helmet of claim 30, further comprising a front pad secured to an inner surface of the helmet and extending across a majority of the front portion of the shell and underlying the cantilevered segment, wherein the front pad includes a boss that is substantially received by the gap.

33. The helmet of claim 29, further comprising a front pad secured to an inner surface of the helmet and extending across a majority of the front portion of the shell and underlying the cantilevered segment, wherein a significant impact force applied to the front portion causes the cantilevered segment to elastically deform and compress a first portion of the front pad while a second portion of the front pad remains substantially uncompressed.

34. The helmet of claim 33, wherein the front pad includes an internal pad component and an overmolded external pad component.

35. The helmet of claim 29, wherein the front portion of the shell includes a lower frontal shell extent, and wherein the lower frontal shell region is positioned between the cantilevered segment and the lower frontal edge, and wherein the lower frontal shell region resists inward displacement when the substantially on-center impact force is applied to the front portion of the shell.

36. The helmet of claim 35, wherein the free end of the cantilevered segment is positioned above the lower frontal shell extent, and wherein the free end of the cantilevered segment is displaced inward of the lower frontal shell region when the substantially on-center impact force is applied to the front portion of the shell.

37. The helmet of claim 29, further comprising a protective face guard coupled to the shell.

* * * * *